US006725003B2

(12) United States Patent
Shinkai et al.

(10) Patent No.: US 6,725,003 B2
(45) Date of Patent: Apr. 20, 2004

(54) IMAGE FORMING APPARATUS HAVING A SUPPORTING DEVICE FOR SUPPORTING IMAGING UNITS

(75) Inventors: Yasuyuki Shinkai, Kanagawa (JP); Kiyoshi Sakai, Tokyo (JP); Satoru Tomita, Kanagawa (JP); Mamoru Kiyota, Kanagawa (JP); Kohji Ichimiya, Saitama (JP); Yuichiro Kanoshima, Kanagawa (JP); Nekka Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 09/964,584

(22) Filed: Sep. 28, 2001

(65) Prior Publication Data

US 2002/0044791 A1 Apr. 18, 2002

(30) Foreign Application Priority Data

Sep. 29, 2000 (JP) ..... 2000-298697
Sep. 13, 2001 (JP) ..... 2001-278930

(51) Int. Cl.[7] ..... G03G 15/00; G03G 21/18
(52) U.S. Cl. ..... 399/112
(58) Field of Search ..... 399/110, 111, 399/112; 430/59.6, 111.3, 111.35

(56) References Cited

U.S. PATENT DOCUMENTS

| | | | | |
|---|---|---|---|---|
| 4,575,219 | A | | 3/1986 | Tomita et al. |
| 4,647,961 | A | | 3/1987 | Kammoto et al. |
| 4,657,372 | A | | 4/1987 | Ikeda et al. |
| 4,696,255 | A | | 9/1987 | Yano et al. |
| 4,760,422 | A | | 7/1988 | Seimiya et al. |
| 4,766,048 | A | | 8/1988 | Hisamura ..... 430/58 |
| 4,841,358 | A | | 6/1989 | Kammoto et al. |
| 4,887,133 | A | | 12/1989 | Ikeda et al. |
| 4,930,438 | A | | 6/1990 | Demizu et al. |
| 4,954,849 | A | | 9/1990 | Koike et al. |
| 4,968,997 | A | | 11/1990 | Saitoh et al. |
| 4,975,749 | A | | 12/1990 | Tsunoda et al. |
| 4,979,727 | A | | 12/1990 | Koike et al. |
| 5,014,091 | A | | 5/1991 | Koike et al. |
| 5,194,959 | A | | 3/1993 | Kaneko et al. |
| 5,266,458 | A | * | 11/1993 | Matsubayashi et al. .. 430/106.1 |
| 5,404,206 | A | | 4/1995 | Andoh et al. |
| 5,840,458 | A | * | 11/1998 | Kido et al. ..... 430/111.4 X |
| 6,122,468 | A | | 9/2000 | Sakamoto et al. ..... 399/223 |
| 6,157,797 | A | | 12/2000 | Saito et al. |
| 6,210,847 | B1 | * | 4/2001 | Miyauchi et al. ..... 430/59.6 X |
| 6,215,974 | B1 | | 4/2001 | Katoh et al. |
| 6,249,304 | B1 | | 6/2001 | Sawayama et al. ..... 347/228 |
| 6,256,461 | B1 | | 7/2001 | Takeyama et al. |
| 6,292,641 | B1 | | 9/2001 | Takeyama et al. |
| 6,308,027 | B1 | | 10/2001 | Obu et al. ..... 399/110 |
| 6,459,868 | B1 | * | 10/2002 | Takahashi et al. ..... 399/112 X |

FOREIGN PATENT DOCUMENTS

| | | | |
|---|---|---|---|
| JP | 62-185441 | | 8/1987 |
| JP | 1-118150 | * | 5/1989 |

(List continued on next page.)

*Primary Examiner*—Fred L. Braun
(74) *Attorney, Agent, or Firm*—Oblon, Spivak, McClelland, Maier & Neustadt, P.C.

(57) ABSTRACT

An image forming apparatus including a plurality of imaging units each for forming an image on a recording medium, an image carrier provided in each of the plurality of imaging unit, a development unit for visualizing an electrostatic latent image on the image carrier by toner in each of the plurality of imaging units, and a supporting device configured to integrate at least two imaging units of the plurality of imaging units into a unit, wherein the supporting device has a plurality of pressing members configured to press upper portions of the at least two imaging units, respectively, and a plurality of supporting members configured to support lower portions of the at least two imagining units, respectively.

19 Claims, 14 Drawing Sheets

FOREIGN PATENT DOCUMENTS

| | | | |
|---|---|---|---|
| JP | 2654954 | | 5/1989 |
| JP | 2-79862 | * | 3/1990 |
| JP | 3066942 | | 10/1995 |
| JP | 8-36346 | | 2/1996 |
| JP | 8-76464 | * | 3/1996 |
| JP | 9-304994 | | 11/1997 |
| JP | 11-174765 | | 7/1999 |
| JP | 11-249493 | | 9/1999 |
| JP | 2000-227706 | | 8/2000 |

* cited by examiner

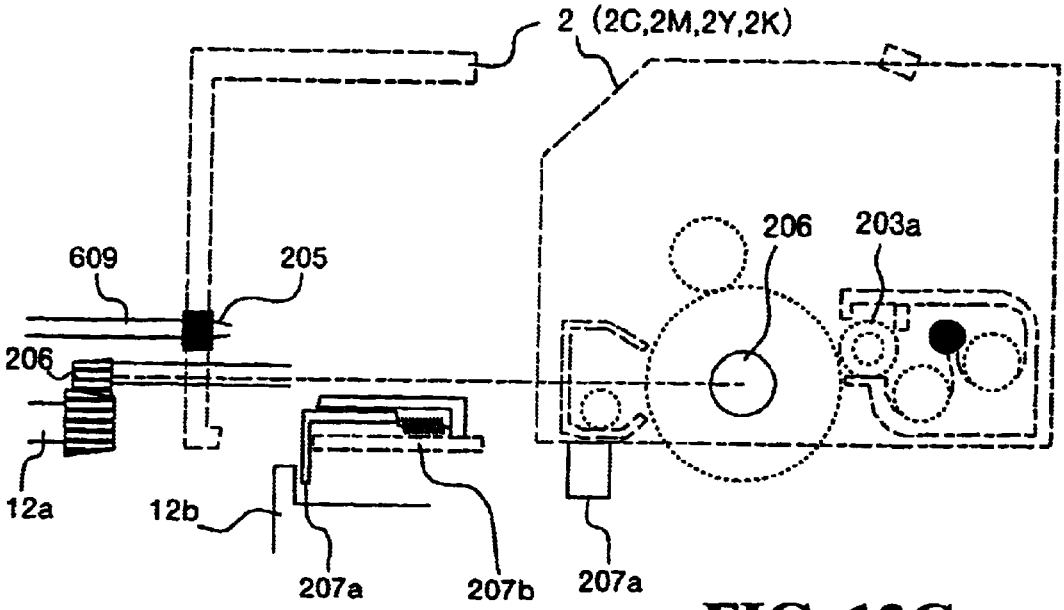
FIG. 13A
FIG. 13C
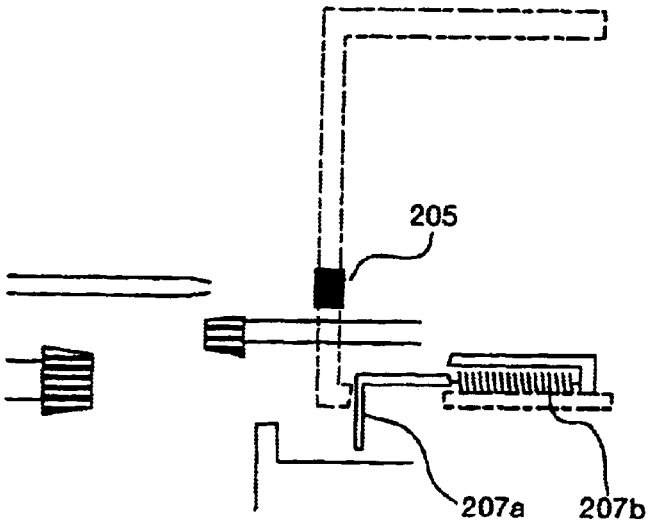
FIG. 13B

IMAGE FORMING APPARATUS HAVING A SUPPORTING DEVICE FOR SUPPORTING IMAGING UNITS

FILED OF THE INVENTION

The present invention relates to an image forming apparatus system such as a copy machine, a facsimile, a printer or the like, and more specifically, an image forming apparatus including a development unit for visualizing an image carrier and an electrostatic latent image on the image carrier by toner and provided with an imaging unit for forming an image on a recording medium.

BACKGROUND OF THE INVENTION

Many maintenances have been conventionally required in an image forming apparatus such as a copy machine, a printer or the like. The reason for the maintenances is that the image forming process of the image forming apparatus holds good on a delicate balance, and the adjustment of balance of each units in the image forming apparatus is required for carrying out good image forming. Further, as a reason for requiring the maintenances, for example, when a low grade paper is used, paper powder adheres on a photosensitizer and the image forming is not carried out well, and the deterioration of a rubber member and the like are mentioned. In particular, concerning the imaging unit for realizing elecrophotography system, there are many requirements for carrying out the maintenance in order to exhibit its quality to maximum. Further, the imaging unit is a system for forming a toner image by elecrophotography process, in the present specification, and means a unit including a development unit for visualizing an image carrier and an electrostatic latent image on the image carrier by toner.

Further, since the life time of the imaging unit is usually shorter than the main body of an image forming apparatus excluding the imaging unit, exchanges are required many times in a process of using one image forming apparatus. For example, as a reason why the life time of the imaging unit is shortened, the wear of the image carrier (photosensitizer), the occurrence of a toner spent phenomenon in which the toner adheres on carrier because of long term use and electrification property and the like are deteriorated in case of two components-development system, and the like are mentioned.

By the way, a maintenance work in which the imaging unit is repaired or exchanged in the use process of the image forming apparatus is divided into a work in which experts such as the service man of a maker and the like mainly carry out repairing, and a work in which a user himself carries out exchange.

In case of a maintenance by the service man and the like, since the imaging unit which is an object of maintenance is repaired by them as many as possible, the imaging unit is scarcely disposed by exchange, and it has a merit of reducing a waste. However, in this case, there is a demerit that a so-called down time that a user cannot use the image forming apparatus until the repairing and exchange by the service man and the like terminate occurs. In particular, concerning the field of a printer which is going to enlarge the market and overseas users, the number of users exceed the number for requiring the service men, and a distance from a service center to the settled location of the image forming apparatus is long, therefore the service men cannot early carry out adequate maintenances, and there is a fear that the down time occurs.

On the other hand, as the image forming apparatus whose maintenance by a user is possible, for example, there are known those in which a process cartridge which integrally constituted an image carrier (photosensitizer) and a development unit is provided in a condition in which it can be freely attached and detached from the main body of the image forming apparatus. Since the process cartridge is made by integrating the image carrier (photosensitizer) and the development unit, it has a merit that a user can easily exchange a process cartridge whose life time has been terminated. However, since a user can easily attach and detach the process cartridge, there is high possibility of being disposed without collecting as a recycle product, therefore a sure recycle is not attained. As described above, there has been a subject in a conventional image forming apparatus how the maintenance, specifically, the maintenance of the imaging units is carried out.

By the way, according to the recent technical innovation by the present inventor, the life time of the imaging units have been steadily elongated. For example, concerning the image carrier (photosensitizer) which has been difficult to maintain quality until the life time of an image forming apparatus, the present inventor succeeded in developing a technology of elongating the life time. According to the technical innovation, the life time of the imaging units can be coped with the life time of the image forming apparatus, or is going to attain a level having a longer life time than the main body of the image forming apparatus.

Thus, when the life time of the imaging units is elongated, the reuse of the imaging units is considered. Wherein 'reuse' is different from 'recycle' in which the imaging units are dismantled and repairing and reproduction by every part are carried out, and means the reutilization of a mode of inserting the imaging units which are extracted from the main body of the image forming apparatus, in the other main body of the image forming apparatus to be used.

Thus, when the reuse of the imaging units comes to be carried out in many image forming apparatuses, its management comes to be important. In particular, in case of a color image forming apparatus, when each imaging units are separately treated in a reuse process, the imaging units having different terms used exist in mixture, therefore there is a fear that the management becomes troublesome.

SUMMARY OF THE INVENTION

It is a first object of the present invention to provide an image forming apparatus by which the management at reusing the imaging units whose life time is elongated can be easily carried out.

Further, when the imaging units which has been the object of maintenance has a life time which can be coped with that of the main body of the image forming apparatus, the maintenance of the imaging units becomes unnecessary by collecting the imaging units together with the main body of the image forming apparatus which is terminated to be used when a user repurchases or renews the image forming apparatus.

Thus, under the circumstances in which the life time of the imaging units which has been the object of maintenance is elongated, the mode in which a user can easily attach and detach the imaging units as the process cartridge is not preferable, and the mode in which a maker collects surely the imaging units and loads them on a recycle process is rather desirable. Namely, when the imaging units come to be surely collected by the maker side, each parts having a long life which constitute the imaging units are used even if they cost high a little, a load required for the maintenance of the imaging units is ignored, and for a maker, there is a possibility of reducing the total cost of the image forming apparatus.

For example, it is assumed that the life time of the imaging units is 3-fold of that of the image forming apparatus. In this case, it is more preferable to use drive parts which have the same life time or more as that of the image forming apparatus even if the price is 2-fold than to use parts whose price is cheap as the material of a member used for driving the imaging units but which have the same life time as that of the image forming apparatus. Namely, since the life time of the imaging units has 3-fold of that of the image forming apparatus, it can be used for three image forming apparatus without carrying out the maintenance of the imaging units. Accordingly, considering personnel expenses which are paid for the maintenance of the imaging units, the imaging units are surely collected by a maker side to make the maintenance of the imaging units unnecessary, therefore the total cost of the image forming apparatus can be reduced. Further, the collection of the imaging units by the maker side is linked to accelerate the elongation of life time of each constitution members which constitute the imaging units in order to reduce the expense required for the collection. Further, since the reuse of the imaging units can be surely carried out thereby, a user does not thoughtlessly dispose the constitution members of the imaging units, and it can be a motive force of the reduction of a load for natural environment. Further, the user also obtains merit by lowering the price which is caused by the reduction of the image forming apparatus.

It is the second object of the present invention to provide the image forming apparatus which can be easily loaded on the reuse process, by surely collecting the image units by a maker side to improve a collection ratio.

A first aspect of the present invention provides an image forming apparatus including at least an image carrier and a development unit for visualizing an electrostatic latent image on the image carrier by toner, and provided with a plurality of imaging units for forming an image on a recording medium, wherein at least two imaging units of among the plurality of imaging units are constituted in one integrated unit.

According to the above aspect, since at least two imaging units are constituted in one integrated unit, a plurality of imaging units which constitute the unit can be simultaneously reused. Thus, it can be prevented that the imaging units are separately loaded on a reuse process, the imaging units whose residual life time is near can be simultaneously reused without managing the residual life time, therefore the management at reusing the imaging units whose life time is elongated can be easily carried out.

Further, a second aspect of the present invention provides an image forming apparatus according to the first aspect, wherein the unit is attachable to and detachable from a main body of the image forming apparatus. According to this aspect, since a constitution that the integrated unit is attachable to and detachable from the main body of the image forming apparatus is made, the unit can be detached without disjointing the main body of the image forming apparatus. Thus, it can be loaded on the reuse process in a short time, and operationability can be improved.

Further, a third aspect of the present invention provides an image forming apparatus according to the second aspect, further comprising a fixation unit which fixes the unit detachably from the main body of the image forming apparatus such that the degree of difficulty of fixation is changeable. According to this aspect, since the unit is fixed by the fixation unit detachably and at the enhanced difficulty of the detachment of fixation against the main body of the image forming apparatus, the detachment of the unit against the main body of the image forming apparatus can be carried out by only the service man of a maker and the like, and it is difficult that a user himself carries out it. Thus, the unit of the image forming apparatus can be surely collected by the maker side, and it is possible to easily load it on the recycle process.

Further, a fourth aspect of the present invention provides an image forming apparatus according to any one of the first to the third aspects, wherein the unit is constituted by jointing the at least two imaging units by a supporting member. According to this aspect, since the unit is constituted by jointing a plurality of imaging units by the supporting member, a plurality of imaging units can be unitized by a simple constitution.

Further, a fifth aspect of the present invention provides an image forming apparatus according to the third aspect, wherein the fixation unit comprises a screw which fixes the unit to the main body of the image forming apparatus using a screw driver, and a fitting groove which is formed on the head part of the screw and in which the edge of the driver is fit is formed in a curve form.

According to the above aspect, since the fitting groove of the screw as the fixation unit in which the edge of the driver is fit is formed in a curve form, the attachment and detachment of the screw cannot be carried out unless a screw driver having a specific edge form is used. Accordingly, it is difficult to carry out the attachment and detachment of the screw unless the service man of a maker and the like carry out it. Thus, each imaging units of the image forming apparatus can be surely collected by the maker side, and it is possible to easily load them on the recycle process, wherein the fixation unit is not limited to the screw, may be any of units in which the unit cannot be detached except a person who is previously appointed, such as a unit of fixation and detaching the unit using keys such as a metal piece, a card and the like, a unit of fixing and detaching it using a specific jig, a unit of fixing and detaching it by inputting a fixed number, a unit of confirming personal information such as a finger print, voice or the like, etc.

Further, a sixth aspect of the present invention provides an image forming apparatus according to any one of the first to fifth aspects, wherein the plurality of imaging units comprise four imaging units for respectively forming toner images of a cyan color, a magenta color, a yellow color and a black color, and the unit is integrally constituted by arranging the four imaging units in a row.

According to the above aspect, since the four imaging units for respectively forming toner images of a cyan color, a magenta color, a yellow color and a black color are unitized by being arranged in a row, each color imaging units (a cyan color, a magenta color, a yellow color and a black color) can be integrally reused.

Further, a seventh aspect of the present invention provides an image forming apparatus according to any one of the first to fifth aspects, wherein the plurality of imaging units comprises four imaging units for respectively forming toner images of a cyan color, a magenta color, a yellow color and a black color, and the unit is integrally constituted by arranging in a row the three imaging units of the four imaging units for respectively forming toner images of cyan color, magenta color and yellow color.

According to the above aspect, since the unit is integrally constituted by arranging in a row the three imaging units of the four imaging units for respectively forming toner images of cyan color, magenta color and yellow color, and the imaging unit of preparing a toner image of the black color is made as a separate body, the imaging units of a cyan color, a magenta color and a yellow color whose residual life time is nearer can be integrally reused. The management of residual life time must be carried out for the imaging unit of the black color, but when there are many outputs of monochrome image and the like, black has a large difference in the residual life time compared with other colors, and those having the same residual life time as the residual life time of other colors is not always put in the same image forming apparatus, therefore it is rational to be separately managed.

Further, an eighth aspect of the present invention provides an image forming apparatus according to any one of the first to seventh aspects, wherein a toner feeding unit for feeding toner to the development unit of each imaging units which constitute the unit is provided separately from the unit. According to the above aspect, since a toner feeding unit for feeding toner to the development unit is provided separately from the unit, toner can be fed to the unit from outside. Thus, the toner in the unit is not exhausted before the unit: terminates its life time.

Further, a ninth aspect of the present invention provides an image forming apparatus according to the eighth aspect, wherein the development units of the each imaging units of the unit and the toner feeding units are constituted to be engageable with and disengageable from each other, and an interlock mechanism where the development units and the toner feeding units are engaged with each other in an interlocking manner when the unit is fixed to the main body of the image forming apparatus by the fixation unit is provided. According to the above aspect, since when the unit is fixed to the main body of the image forming apparatus by the fixation unit, the development unit and the toner feeding unit are hooked and linked, there is no requirement other than the detachment of the fixation unit when the unit is detached from the main body of the image forming apparatus, and operationability is improved.

Further, a tenth aspect of the present: invention provides an image forming apparatus according to ninth aspect, wherein each imaging units of the unit includes a cleaning unit for eliminating the residual toner on the image carrier, and a toner storing unit for storing waste toner which the cleaning unit eliminates from the image carrier is provided separately from the unit. According to the above aspect, since the toner storing unit is provided separately from the unit, waste toner can be discharged to the outside of the unit. Thus, there is no possibility of being unable to use because the waste toner is filled up in the unit before the unit terminates its life time.

Further, an eleventh aspect of the present invention provides an image forming apparatus according to any one of the first to tenth aspect, wherein the toner image formed on the image carrier is transferred on the recording medium through an intermediate transfer member.

According to the above aspect, since the toner image which is formed on the image carrier is transferred on the recording medium through the intermediate transfer body, for example, as the recording medium, a paper powder such as a recording paper or the like is not directly adhered on the photosensitizer as the image carrier, and the elongation of the life time of the unit can be designed.

Further, a twelfth aspect of the present invention provides an image forming apparatus according to any one of the first to eleventh aspect, wherein the image carrier of the each imaging unit which constitutes the unit contain a particle-like substance on a surface layer of the image carrier. According to this aspect, the surface layer of image carrier is gradually shaved, for example, by a cleaning blade, the particle-like substance becomes naked to a certain degree, and the particle-like substance is naturally pealed. Thus, a new surface layer is exposed on the surface of the image carrier, and the elongation of the life time of the image carrier and refresh effect are attained together.

Further, a thirteenth aspect of the present inventions provides an image forming apparatus according to the twelfth aspect, wherein the content of the particle-like substance in the surface layer of the image carrier is 5 to 50% by weight.

According to the research of the present applicant, when the content of the particle-like substance is 5% by weight or less, the effect of wear resistance of the image carriers hardly occurs, and when it is 10% by weight or more, an adequate wear resistance is obtained. Further, when the content of the particle-like substance is 40% by weight or more, the deterioration of an image such as a dirt ground or the like which is caused by making the film of surface layer of the image carriers opaque occurs, and when it is 50% by weight or more, it is cleared that the transparency of the photosensitive layer is damaged.

Further, a fourteenth aspect of the present invention provides an image forming apparatus according to the twelfth or the thirteenth aspect, wherein an average particle diameter of the particle-like substance is 0.05 to 1.0 $\mu$m.

When an average particle diameter of the particle-like substance does not reach to 0.05 $\mu$m, an adequate wear resistance effect is not obtained. Further, when an average particle diameter of the particle-like substance is larger than 1.0 $\mu$m, the portion of the particle-like substance is protruded on the surface of the image carriers, and damages the cleaning blade, therefore it causes the inferiority of cleaning.

Further, a fifteenth aspect of the present invention provides an image forming apparatus according to twelfth, thirteenth or fourteenth aspect, wherein a film thickness formed by lamination of layered particle-like substance layers in which the particle-like substance is added is 0.5 to 10 $\mu$m.

According to the research of the present applicant, since the thickness of a case of forming by lamination of the layered particle-like substance layer in which the particle-like substance is added is 0.5 to 10 $\mu$m, a good result is obtained.

Further, a sixteenth aspect of the present invention provides an image forming apparatus according to any one of the first to eleventh aspects, wherein the development units of the each imaging units which constitute the unit develops the latent image on the image carrier by a two components developer which contains toner and carrier, and the carrier that a coating layer comprising soft segment and hard segment is provided on a surface of a core material comprising at least magnetic substance.

According to the above aspect, the coating layer with wear resistance having elasticity which comprises the soft segment and hard segment is obtained on the surface of a core material which comprises at least a magnetic substance, of the carrier. As a result, at stirring for charging the developing agent by friction, a contact accompanied with an intensive impact to the coating layer which is caused by the friction with toner or the mutual friction of the carriers is absorbed. Thus, the toner spent to the toner can be suppressed, the shave of the film can be prevented, and the improvement effect of durability is remarkable, wherein the soft segment means a soft phase or an elastic component in the coating layer and the hard segment is a hard phase or a molecule binding component, and the former absorbs impact and the latter imparts a reinforcing effect.

Further, a seventeenth aspect of the present invention provides an image forming apparatus according to the sixteenth aspect, wherein the coating layer of the carrier contains a larger particle than the thickness of the coating layer.

According to the research of the present applicant, since the larger particle than the thickness of the coating layer is contained in the coating layer, the particle becomes convex as compared with the coating film of the image carrier. Thus, a contact accompanied with an intensive impact to the coating layer which is caused by the friction with toner or the mutual friction of the Do carriers can be mitigated by stirring for electrifying the developing agent by friction. Further, the toner spent to the carrier can be prevented thereby, the film shaving of a coating resin which is the spot of electrification occurrence can be prevented, and improvement effect is remarkable. Wherein when the particle is smaller than the thickness of the coating layer, the particle is buried in the coating resin, therefore effect is remarkably lowered. Further, when the particle is larger than 10-fold of the thickness of the coating layer, the contact area of the particle with the coating resin is little, therefore an adequate adhesive force is not obtained, and the particle is easily separated.

Further, an eighteenth aspect of the present invention provides an image forming apparatus according to the seventeenth aspect, wherein the content of the particle is 20 to 80% by weight based on coating resin of the coating layer.

According to the above aspect, when the content of the particle is less than 20% by weight based on the coating resin of the coating layer, the proportion of the particle which occupies is little as compared with the proportion of the coating resin of the particle surface of the carrier, therefore a contact accompanied with an intensive impact to the coating resin is not obtained adequately. Further, when the content is more than 80% by weight, the proportion of the particle which occupies is too much as compared with the proportion of the coating resin on the surface of the carrier, therefore the proportion of the coating resin which is the spot of electrification occurrence is inadequate and an adequate electrification ability is not obtained.

Other objects and features of this invention will become understood from the following description with reference to the accompanying drawings.

BRIEF DESCRIPTION OF THE DRAWINGS

FIGS. 13(*a*) and (*b*) are schematic section views in which a mechanism which links each engine units against the main body of an image forming apparatus is viewed from the side face of an image forming apparatus.

FIG. 13(*c*) is a schematic frontal view of each engine units.

DESCRIPTION OF THE PREFERRED EMBODIMENT

The preferable modes of operation in which the image forming apparatus of the present invention is applied to a color image forming apparatus are described in the order of (a first preferred embodiment) and (a second preferred embodiment). Further, in the present specification, the imaging unit is a system for forming a toner image by elecrophotography process, and means a unit including a development unit for visualizing an image carrier and an electrostatic latent image on the image carrier by toner. Further, the constitution elements of the imaging units such as the image carrier, the developing unit and the like which constitute the imaging units are called as the imaging member.

Figure 1:
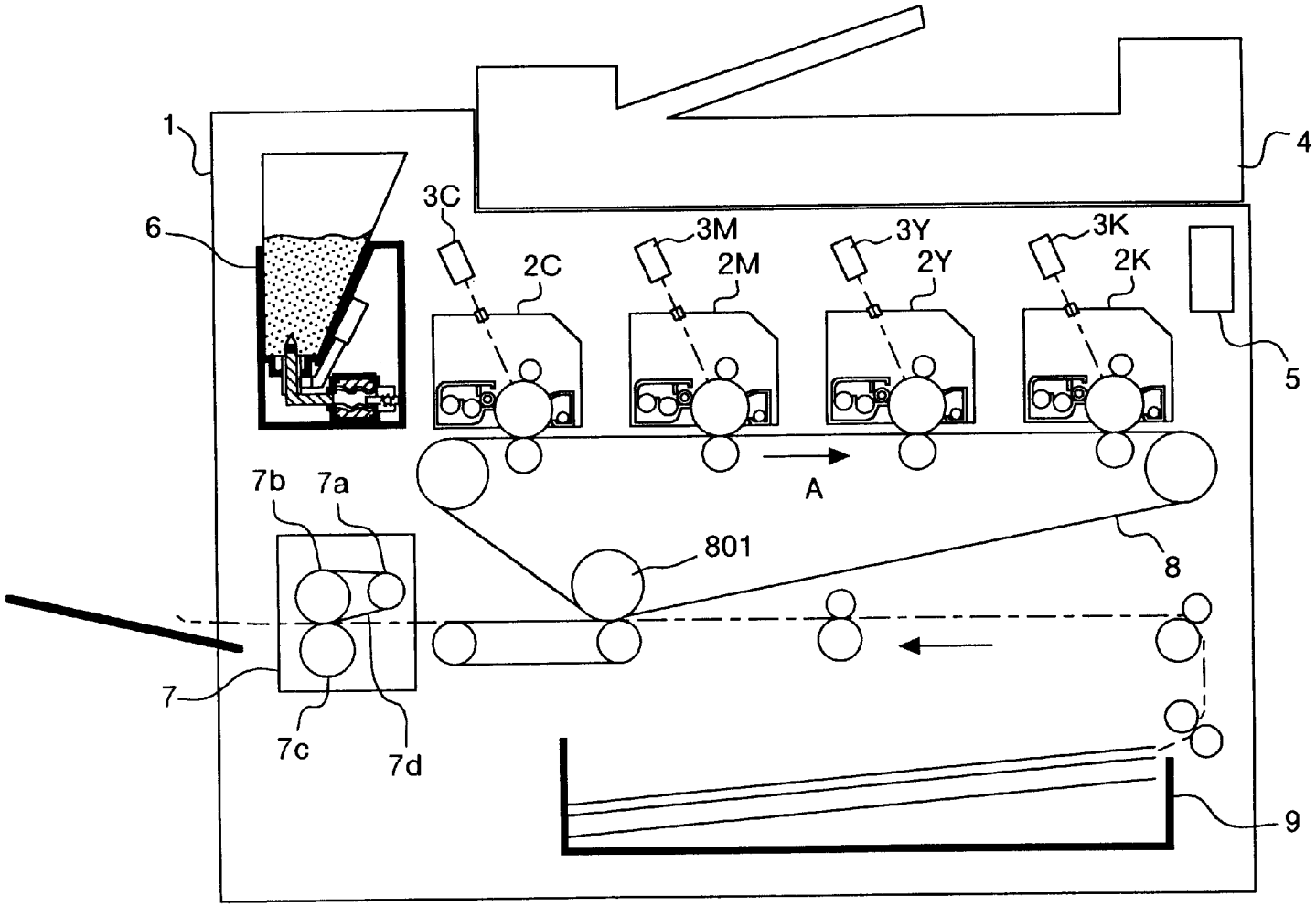
FIG. 1 is a schematic constitution view showing the whole constitution of an image forming apparatus related to a first preferred embodiment of the present invention.

One example of the whole schematic constitution of the color image forming apparatus related to the present invention is shown in FIG. 1. The whole motion of the image forming apparatus 1 is controlled by a controller 5. The controller 5 is provided with memories and the like for preserving CPU for carrying out each treatments and images. Further, four LED arrays of 3C, 3M, 3Y and 3 having the same structure for writing the latent images which correspond to the toner images of a cyan color, a magenta color, a yellow color and a black color, as image carriers on a photosensitizer are provided in the image forming apparatus 1.

Further, four engine units 2C, 2M, 2Y and 2K having the same structure for respectively forming the toner images of a C (cyan) color, a M (magenta) color, a Y (yellow) color and a K (black) color, on the intermediate transfer belt 8 by receiving the writes from each LED arrays 3C, 3M, 3Y and 3K are mounted in the image forming apparatus 1. Further, in the present preferred embodiment, each engine units of 2C, 2M, 2Y and 2K correspond to each imaging units. The four engine units 2C, 2M, 2Y and 2K (imaging units) are constituted as an integrated unit, as described later (refer to FIG. 5 and the like).

Toners corresponding to the toner images of each colors are fed to each engine units (imaging units) 2C, 2M, 2Y and 2K by the toner feeding units 6C, 6M, 6Y and 6K which are four toner feeding units. Each toner feeding units 6C, 6M, 6Y and 6K are provided so as to be along the width direction of the intermediate transfer belt 8 which rotates to a direction which is shown by an arrow mark A in FIG. 1.

Figure 2:
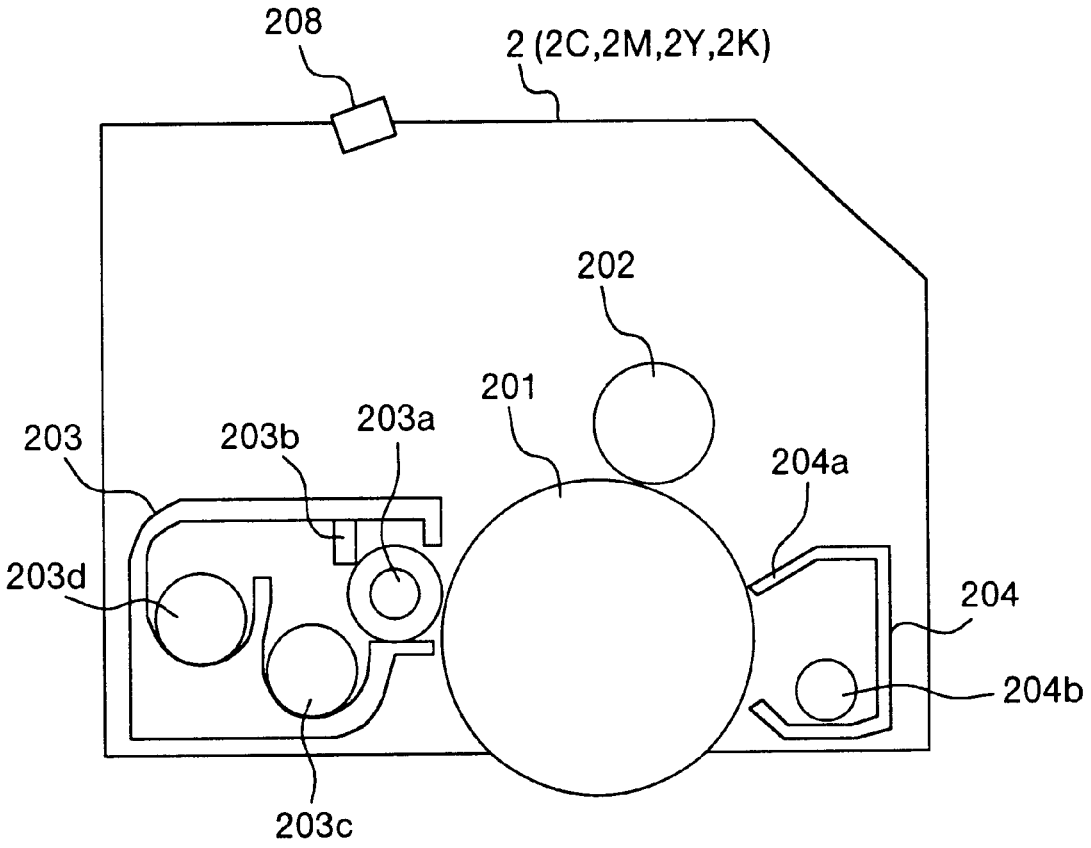
FIG. 2 is a schematic constitution view showing a magnified engine units which are mounted on the main body of an image forming apparatus of the image forming apparatus

Then, one example of the constitution of each engine units (imaging units) 2C, 2M, 2Y and 2K is described. These respective engine units (imaging units) 2C, 2M, 2Y and 2K have the same structure, and have a constitution that a plurality of imaging members are unitized. Since each engine units (imaging units) 2C, 2M, 2Y and 2K have the same structure, the engine unit (imaging unit) is described as Code 2 in FIG. 2. For example, as shown in FIG. 2, each imaging units which comprises of the photosensitizer 201 which is the image carrier, the electrification unit 202 which is provided around the photosensitizer 201 and comprises the electrification roller as the electrification unit which electrifies the surface of the photosensitizer 201, the developing unit 203 as the developing unit which forms the toner images on the photosensitizer 201 by adhering the charged toner on the latent image on the photosensitizer 201, the cleaning unit 204 as the cleaning unit which eliminates the residual toner on the photosensitizer 201 after transfer of the toner images to the intermediate transfer belt 8, and the like are arranged in a plastic box body and unitized. The opening part 208 for introducing the write light from each LED arrays 3C, 3M, 3Y and 3K is provided at the box body.

Further, in the present preferred embodiment, each engine unit (imaging units) 2C, 2M, 2Y and 2K have the photosensitizer 201, the electrification unit 202, the developing unit 203, and the cleaning unit 204 as the constitution elements, but as the imaging units of the present invention, the photo sensitizer 201 and the developing unit 203 are the essential constitution elements. Namely, a constitution by which the image can be formed by a single body may be well, and for example, the cleaning unit is unnecessary in case of a mechanism of collecting the residual toner of transfer by the electrification unit.

Then, the outline of image forming motion of the image forming apparatus 1 of FIG. 1 is described. After the digital image data obtained by the scanner 4 or through a net work line not illustrated is treated with image processing such as gradation treatment or the like by the controller 5, it is transmitted to the LED arrays 3C, 3M, 3Y and 3K as write signal. The LED arrays 3C, 3M, 3Y and 3K irradiate each write lights on the photosensitizers in the engine units (imaging units) 2C, 2M, 2Y and 2K, and each engine units (imaging units) 2C, 2M, 2Y and 2K transfer the toner images corresponding to the write lights on the intermediate transfer belt 8. At this time, the controller 5 adjusts the timing of the write lights of the LED arrays 3C, 3M, 3Y and 3K so that the toner images of each colors duplicate on the intermediate transfer belt 8 to be able to form a full color image.

The full color image which is formed on the intermediate transfer belt 8 move to the arrow direction of the drawing, and is transferred on a recorded body which is sent from the paper feeding tray 9 by matching the timing at which the full color image reaches on the transfer roller 801. The full color image on the recorded body is fixed on the recorded body by melting the toner by the fixation belt 7*d* which is heated by the heating roller 7*a* and pressuring the toner by a pair of the pressuring rollers 7*b* and 7*c*, and discharged to the outside of the unit.

Many units are carried out to each engine units (imaging units) 2C, 2M, 2Y and 2K for the elongation of life time. In particular, a unit for the elongation of life time is carried out for the photosensitizer which have been frequently exchanged in a conventional image forming apparatus. By the way, as the developing agent which is stored in the developing unit 203, either of a two components developing agent which is obtained by mixing toner and carrier or a one component developing agent which does not contain the carrier may be used, but a two components developing agent is used in the present: preferred embodiment. Problems of the difficulty in appropriately adjusting a ratio of toner to carrier and the lowering of developing property caused by adherence of the toner on the surface of the carrier (toner spent) have been conventionally mentioned for the two components developing agent. In particular, when the developing property is lowered because of the toner spent, there occurs the exchange of the carrier or the developing unit 203, therefore it has been an obstacle for elongation of the life time of the developing unit 203. Accordingly, a unit is carried out in order to elongate the life time of the carrier in the developing unit 203 of the present preferred embodiment, and the elongation of the life time of the developing unit 203 is designed.

The constitution of each imaging units which are mounted in each engine units (imaging units) 2C, 2M, 2Y and 2K is described in detail below. Concerning those for which units for elongation of the life time are carried out, the units are also described together. 'Photosensitizer 201'

Firstly, the photosensitizer 201 of the present preferred embodiment is described.

Figure 3A:
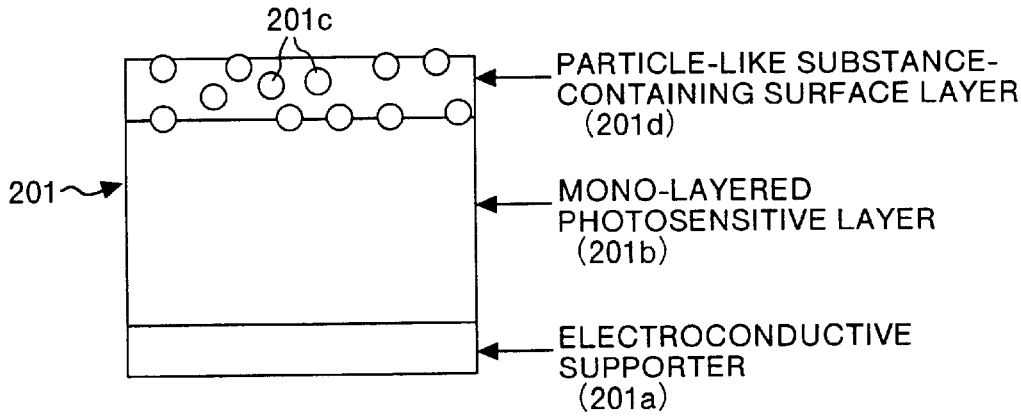
FIGS. 3A, 3B and 3C are schematic magnified section views for illustrating multi layered structures of a photosensitizer.
Figure 3B:
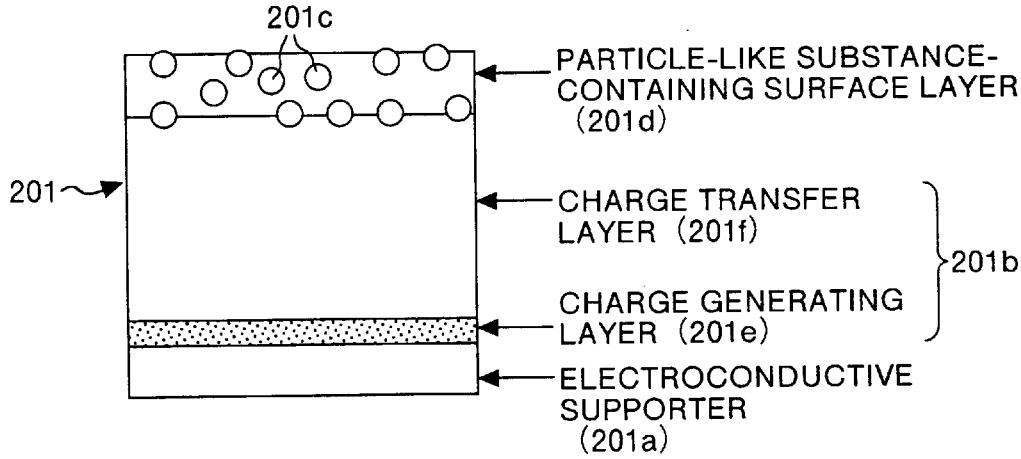
Figure 3C:
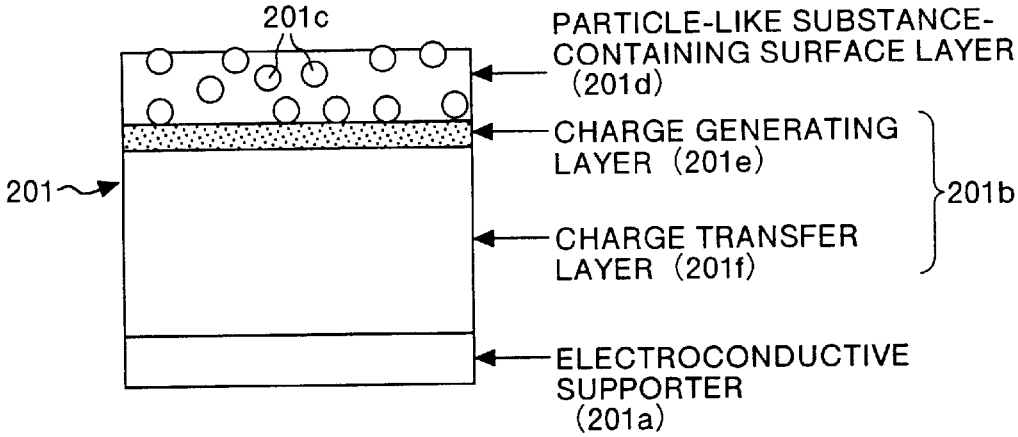

As shown in FIG. 3A, FIG. 3B and FIG. 3C, the photosensitizer 201 is a multi-layered structure which comprises the photosensitive layer 201*b* which is constituted by a charge generating substance which generates charge by absorbing light on the electro conductive supporter 201*a* as the electro conductive substrate and the charge transfer substance which transfers the charge generated to the inside of the photosensitive layer, and the particle-like substance-containing surface layer 201*d* in which the particle-like substance 201*c* is contained.

As the constitution of the photosensitive layer 201*b*, there are a mono-layered structure type which contains the charge generating substance and the charge transfer substance as shown in FIG. 3A, and the multi-layered structure type which laminates the charge generating layer 201*e* comprising the charge generating substance and the charge transfer layer 201*f* comprising the charge transfer substance as shown in FIG. 3B and FIG. 3C. Either of the types can be used in the image forming apparatus related to the present preferred embodiment.

Layers of the photosensitizer 201 in which the photosensitive layer 201*b* as shown FIG. 3A, FIG. 3B and FIG. 3C is the multi-layered structure type are described indetail.

1. Particle-like substance-containing surface layer 201*d* The particle-like substance-containing surface layer 201*d* may be constituted by the particle substance 201*c*, a binder resin and a low molecule charge transfer substance as a main component, or the particle substance 201*c* and a polymer charge transfer substance as a main component. Each substances are described below.

[Constitution of particle-like substance-containing surface layer 201*d*]

The content of the particle-like substance 201*c* in the particle-like substance-containing surface layer 201*d* is required to be 5 to 50% by weight, and preferably 10 to 40% by weight. Namely, according to the research of the present applicant, when the content of the particle-like substance 201*c* is 5% by weight or less, the effect of wear resistance of the photosensitizer 201 hardly occurs, and when it is 10% by weight or more, an adequate wear resistance is obtained.

Further, when the content of the particle-like substance 201*c* is 40% by weight or more, the deterioration of an image such as a dirt ground or the like which is caused by making the film of surface layer of the image carriers opaque occurs, and when it is 50% by weight or more, it is cleared that the transparency of the photosensitive layer 201*b* is damaged.

[Particle-like substance 201*c*]

The particle-like substance is a substance which contained in order to prevent the wear of the photosensitizer 201 and to elongate the life time. An average particle diameter of the particle-like substance 201*c* is preferably 0.05 to 1.0 $\mu$m. When the particle diameter does not reach at 0.05 $\mu$m, an adequate wear resistance effect is not obtained. Further, when the particle diameter is larger than 1.0 $\mu$m, the portion of the particle-like substance is protruded on the surface of the image carriers, and damages the cleaning blade of the cleaning unit 204, therefore it causes the inferiority of cleaning.

Further, as the particle-like substance 201*c*, a particle-like substance being harder than the resin which constitutes the surface layer of the photosensitizer 201 can be used, and either of an inorganic substance and an organic substance can be used. Examples include metal oxides such as titanium oxide, silica, stannic oxide, alumina, zirconium oxide, indium oxide, silicone nitride, calcium oxide, zinc oxide, barium sulfate and the like. Among these, titanium oxide, silica, zirconium oxide and the like are preferably mentioned in particular. The surface of these oxides may be treated with an inorganic substance and an organic substance because of improving dispersibility. For example, as water repellent treatment, those treated with a silane coupling agent, or those treated with a fluorine-based silane coupling agent, or those treated with a higher fatty acid may be used. As inorganic treatment, those obtained by treating the surf ace of a filler with alumina, zirconia, stannic oxide, and silica can be used.

[Binder resin]

As the binder resin of the particle-like substance 201*d*, a thermoplastic resin and a curable resin can be used. Examples of the binder resin include an acryl resin, a polyester, a polycarbonate, a polyamide, a polyurethane, a polyethylene, an epoxy resin and the like. Particularly preferable binder resin is the polycarbonate which is indicated by the general formulae (Formulae 1 and 2) below:

[Formula 1]

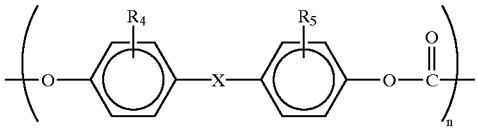

[Formula 2]

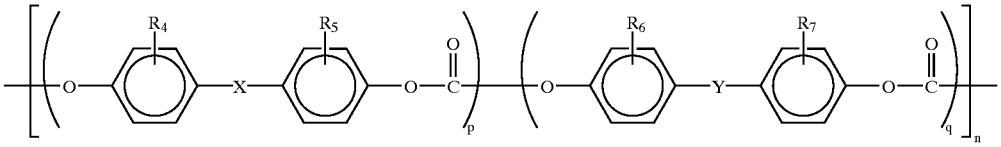

In the general formulae (Formulae 1 and 2), each of $R_4$, $R_5$, $R_6$ and $R_7$ represents independently a hydrogen atom, a substituted or non substituted alkyl group or a halogen atom, or a substituted or non substituted aryl group.

X represents an aliphatic di-valent group and a cyclic aliphatic di-valent group.

Y represents a single joint, a linear chain, branched or cyclic alkylene group having carbon atoms 1 to 12, —O—, —S—, —SO—, —$SO_2$—, —CO—, and —CO—O—Z—O—CO— (wherein Z represents an aliphatic di-valent group), or

[Formula 3]

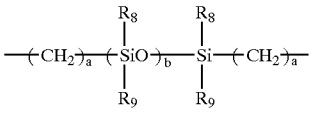

(wherein a represents an integer of 1 to 20, b represents an integer of 1 to 2000, and $R_8$ and $R_9$ represents a substituted or non substituted alkyl group or aryl group). Wherein $R_6$ and $R_7$ and $R_8$ and $R_9$ maybe the same or different respectively. p and q represents a composition; $0.1 \leqq p \leqq 1$ and $0 \leqq q \leqq 0.9$, and n represents a number of repeating units and an integer of 5 to 5000.

These polycarbonates have high toughness and good film property. Further, since the particle-like substance-containing surface layer 201*d* is required to have a charge transfer function, it is an important condition to have good compatibility with a low molecule charge transfer material. Accordingly, the polycarbonates which are indicated by the general formulae (Formulae 1 and 2) are preferable.

Formulae 4 to 10 of the specific examples of the polycarbonate are mentioned. However, the polycarbonate which can be used for the photosensitizer 201 of the present preferred embodiment is not limited to theses.

[Formula 4]

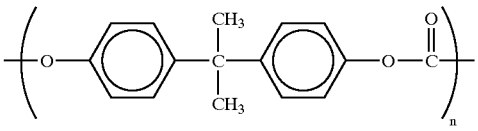

[Formula 5]

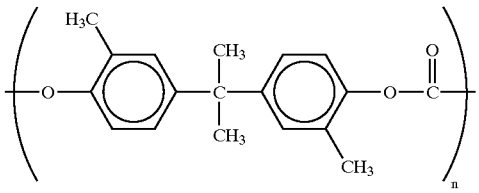

[Formula 6]

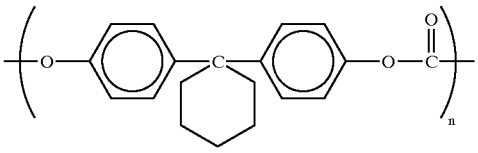

[Formula 7]

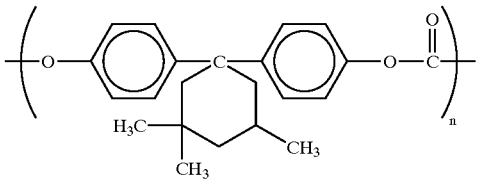

[Formula 8]

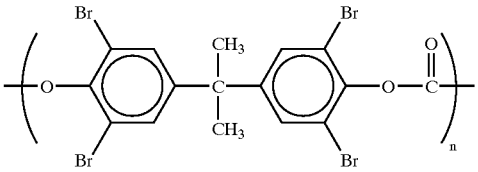

[Formula 9]

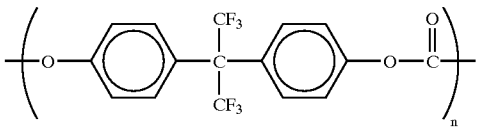

[Formula 10]

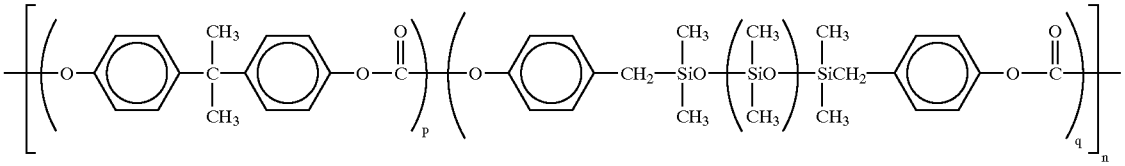

[Low molecule charge transfer substance]

A low molecule charge transfer substance can be further added to the particle-like substance-containing surface layer 201*d* in order to impart a charge transfer function to the particle-like substance-containing surface layer 201*d*. As the low molecule charge transfer substance added, a donor type substance having positive charge carrier transfer function and an acceptor type substance having a negative charge carrier transfer function can be used. These low molecule charge transfer substances are required to be appropriately selected according to the polarity of the surface charge of the photosensitizer 201 which forms the latent image. Hereat, a case that the photosensitizer 201 of the present embodiment is a negatively electrified photosensitizer is shown.

Examples of the low molecule charge transfer substance in this case include an oxazole derivative, an oxadiazole derivative, an imidazole derivative, a triphenylamine derivative, 9-(p-diethylaminostyrylanthrathene), 1,1-bis-(4-dibenzylaminophenyl) propane, styrylanthrathene, styrylpyrazoline, phenylhydrazones, α-phenylstilbenes, a thiazole derivative, a triazole derivative, aphenazine derivative, anacridine derivative, a benzofuran derivative, a benzimidazole derivative, a thiophene derivative, and the like.

These low molecule charge transfer substance can be used alone or as a mixture of 2 or more thereof. Further, the ratio of the content (D) of the low molecule charge transfer substance in the particle-like substance-containing surface layer 201*d*, the content (R) of the binder resin and the content (F) of the particle-like substance is preferably D:R:F=10 to 40:35 to 55:5 to 40% by weight. Namely, when the low molecule charge transfer substance is less than 10% by weight, potential raise at bright portion which is considered to be caused by charge-transfer property occurs, and when it is more than 40% by weight, the lowering of film strength is generated. Further, the binder resin is used for fixing the low molecule charge transfer substance and the particle-like substance, when it is less than 35% by weight, the embrittlement of the particle-like substance-containing surface layer 201*d* occurs, and when it is more than 55% by weight, the balance of the content of the low molecule charge transfer substance and the particle-like substance, and the points of electric properties and film strength are not preferable. Further, when the content of the particle-like substance is less than 5% by weight, the wear resistance of the particle-like substance-containing surface layer 201*d* not preferable, and when it is more than 40% by weight, the deterioration of an image such as a dirt ground or the like which is caused by making the film of surface layer of the image carriers opaque is generated. Further, as the low molecule charge transfer substance, a substance indicated by the following general formula (Formula 11) is preferable. The low molecule charge transfer substance has a high speed of charge mobility and good compatibility with the binder resin.

[Formula 11]

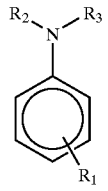

Wherein $R_1$ represents a hydrogen atom, a substituted or non substituted alkyl group or a halogen atom. Further, a preferable alkyl group is a C1 to C12, particularly C1 to C8, and more preferably C1 to C4 linear or branched chain alkyl group. Further, these alkyl groups may contain a fluorine atom, a hydroxy group, a cyano group, a C1 to C4 alkoxy group, aphenyl group, or a phenyl group substituted with a halogen atom, a C1 to C4 alkyl group, or a C1 to C4 alkoxy group. Specific examples include a methyl group, an ethyl group, a n-propyl group, an isopropyl group, a tert-butyl group, a sec-butyl group, a n-butyl group, an isobutyl group, a trifluoromethyl group, a 2-hydroxyethyl group, a 2-cyanoethyl group, a 2-ethoxyethyl group, a 2-methoxyethyl group, a benzyl group, a 4-chlorobenzyl group, a 4-methylbenzyl group, a 4-methoxybenzyl group, a 4-phenylbenzyl group, and the like. Further, as a halogen atom, a fluorine atom, a chlorine atom, a bromine atom and an iodine atom are mentioned. Further, these are one of examples and the $R_1$ is not limited to these.

Further, $R_2$ and $R_3$ of the general formula (Formula 11) represents a substituted or non substituted aryl group. As one example, the following can be mentioned:

(1) an aromatic hydrocarbon group such as a styryl group, a phenyl group, (2) a condensed polycyclic group such as a naphthyl group, a pyrenyl group, a fluorenyl group, a 9,9-dimethyl-2-fluorenyl group, an azulenyl group, an anthoryl group, a triphenylenyl group, a chrysenyl group, a fluorenylidenephenyl group, a 5H-dibenzo[a, d] cycloheptenylidenephenyl group, (3) a non-condensed polycyclic group such as a biphenyl group, a terphenyl group, and (4) a heterocyclic group such as a thienyl group, a benzothienyl group, a furyl group, a benzofuranyl group, a carbazolyl group.

Further, the aryl group may have the group indicated below as a substituent:

a halogen atom, a trifluoromethyl group, a cyano group, a nitro group, a fluorenyl group, an alkyl group, an alkyl group, an alkoxy group, an aryloxy group; a phenyl group, a naphthyl group as an aryl group; a C1 to C4 alkoxy group, a substituted mercapto group, an a rylmercapt-o group, an alkyl-substituted amino group, and an acyl group.

[Polymer charge transfer substance]

The polymer charge transfer substance is linked with a carbonate jointing, and has good film property and charge transfer function. Accordingly, it becomes unnecessary to add the low molecule charge transfer substance or the inert binder resin using the polymer charge transfer substance. Further, the low molecule charge transfer substance or the inert binder resin can be added according to requirement.

One example of the polymer charge transfer substance is indicated by the following general formulae (Formulae 12 to 21).

[Formula 12]

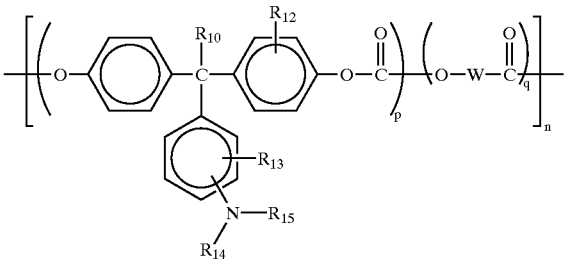

[Formula 13]

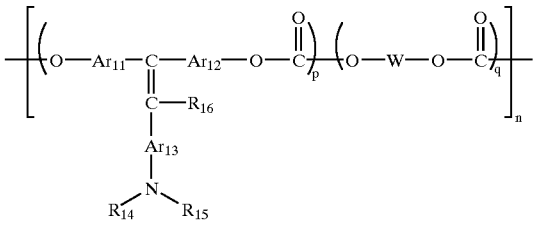

[Formula 14]

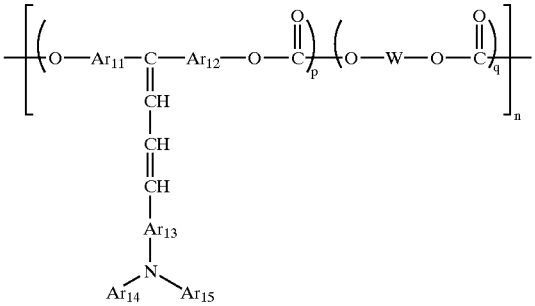

[Formula 15]

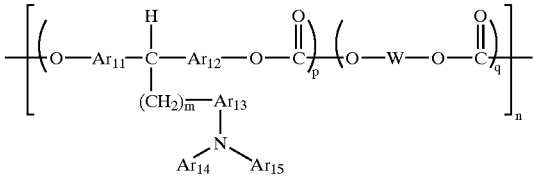

[Formula 16]

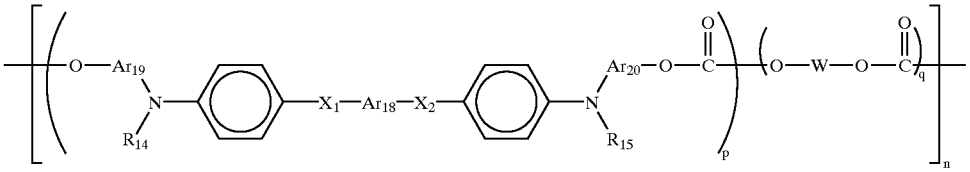

-continued

[Formula 17]

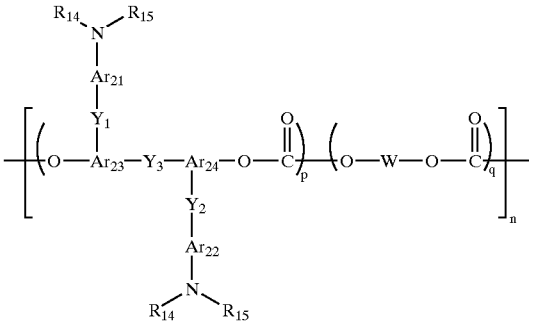

[Formula 18]

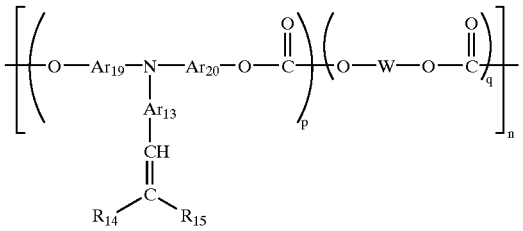

[Formula 19]

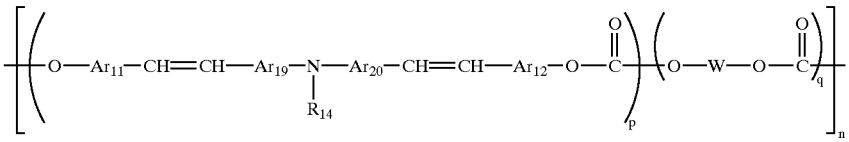

[Formula 20]

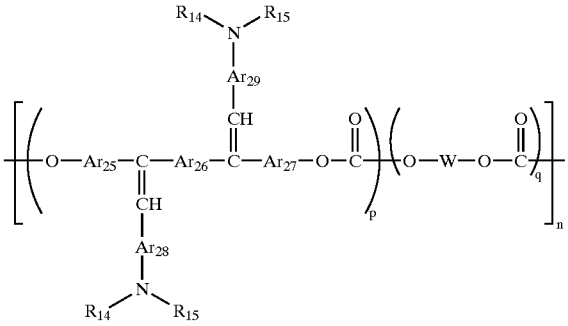

[Formula 21]

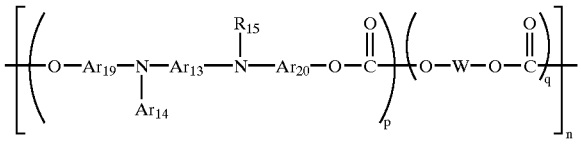

In the general formulae, each of $R_{11}$, $R_{12}$ and $R_{13}$ is a hydrogen atom, or a independent substituted or non substituted alkyl group or a halogen atom. $R_{10}$ is a hydrogen atom, or a substituted or non substituted alkyl group. $R_{14}$ and $R_{15}$ are a substituted or non substituted aryl group. $R_{16}$ is a hydrogen atom, a substituted or non substituted alkyl group, or a substituted or non substituted aryl group. $Ar_{11}$, $Ar_{12}$, $Ar_{13}$, $Ar_{18}$, $Ar_{19}$, $Ar_{20}$, $Ar_{21}$, $Ar_{22}$, $Ar_{23}$, $Ar_{24}$, $Ar_{25}$, $Ar_{26}$, $Ar_{27}$, $Ar_{28}$ and $Ar_{29}$ are the same or different arylene group. p and q represents a composition; $0.1 \leqq p \leqq 1$ and $0 \leqq q \leqq 0.9$. n represents a number of repeating units and an integer of 5 to 5000. m is an integer of 1 to 5. Y1, Y2 and Y3 represent a single joint, a substituted or non substituted alkylene group, a substituted or non substituted cycloalkylene group, a substituted or non substituted alkylene ether group, group, an oxygen atom, a sulfur atom, and a vinylene group and may be the same or different. W represents an aliphatic di-valent group and acyclic aliphatic di-valent group, or a di-valent group represented by the under-mentioned general formula (Formula 22):

[Formula 22]

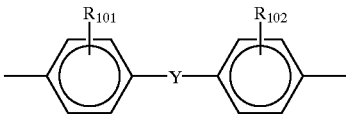

Wherein each of $R_{101}$ and $R_{102}$ represents an independent substituted or non substituted alkyl group or aryl group or a halogen atom. Y is a single joint, a linear chain, branched or cyclic alkylene group having carbon atoms 1 to 12, —O—, —S—, —SO—, —$SO_2$—, —CO—, and —CO—O—Z—O—CO—(Z represents an aliphatic di-valent group in the general formula).

Specific example of the polymer charge transfer substance is shown Formulae 23 to 31 below. Further, the polymer charge transfer substance which can be used for the photosensitizer 201 of the present preferred embodiment is not limited to these.

[Formula 23]
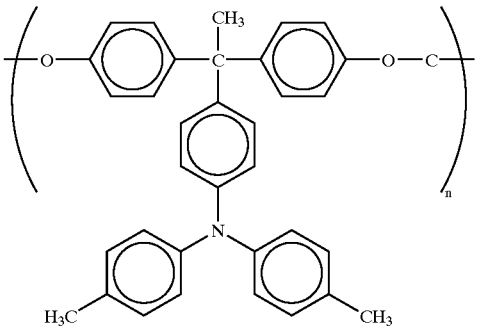
[Formula 24]
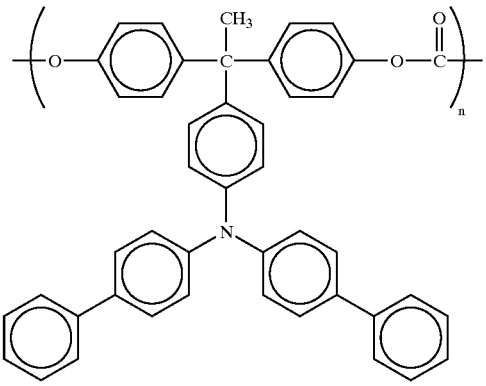
[Formula 25]
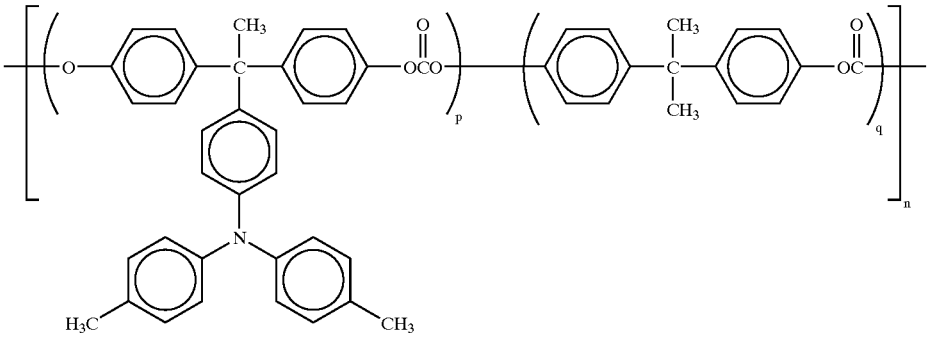
[Formula 26]
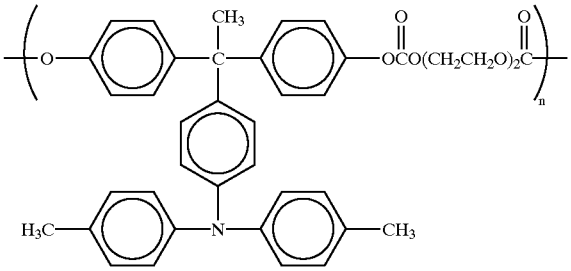
[Formula 27]
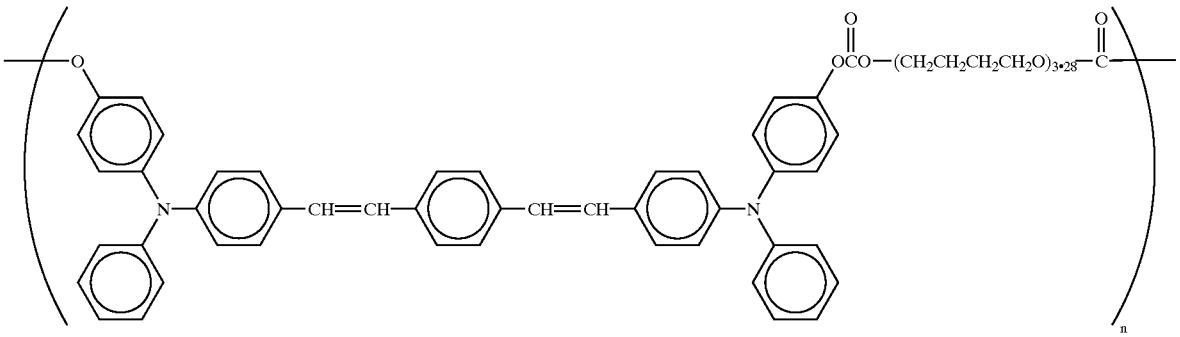

-continued

[Formula 28]

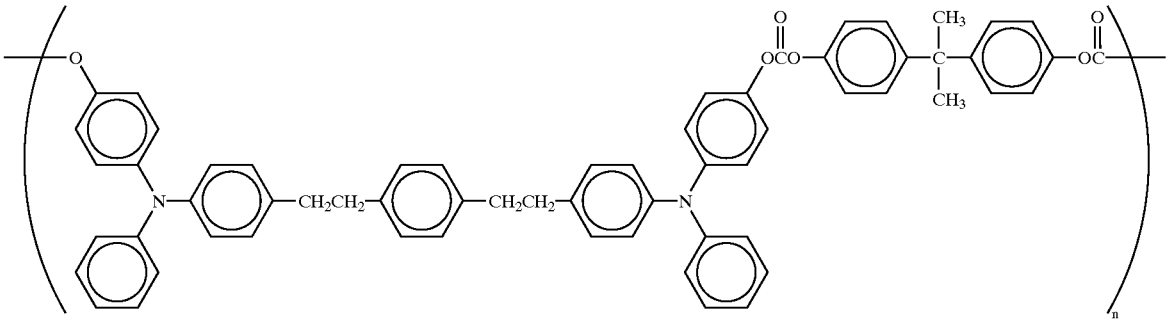

[Formula 29]

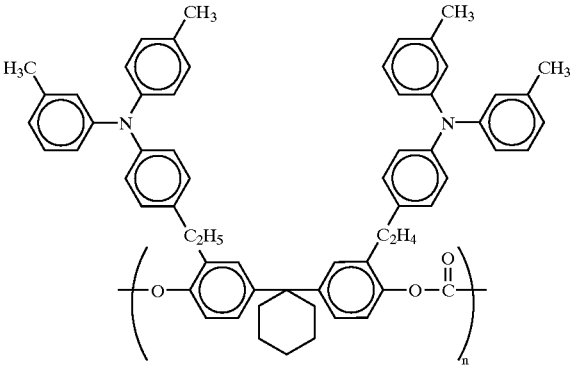

[Formula 30]

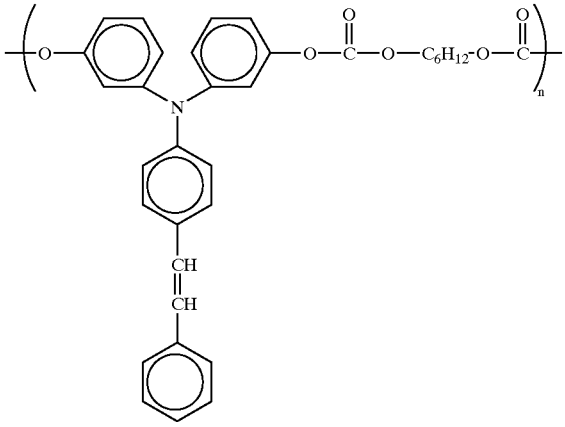

[Formula 31]

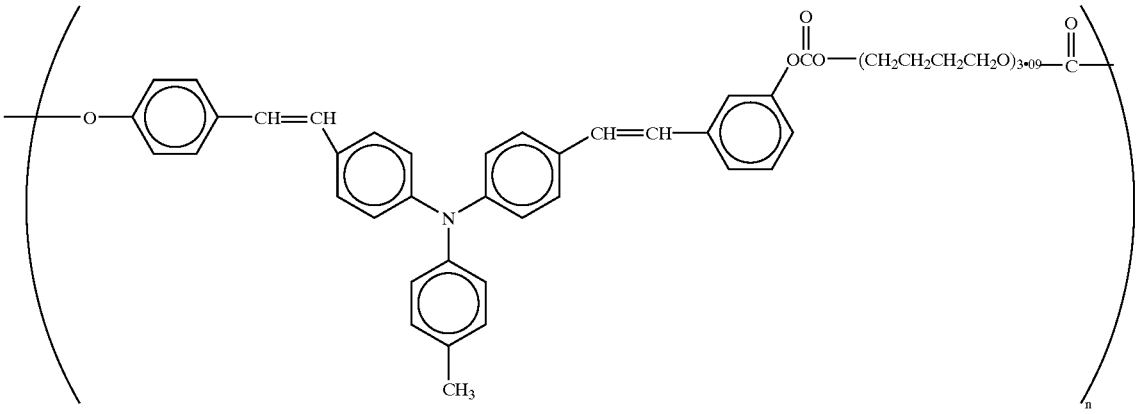

[Method of forming particle-like substance-containing surface layer 201*d*]

The particle-like substance-containing surface layer 201*d* can be formed by coating the particle-like substance 201*c* which is pulverized and dispersed together with the low molecule charge transfer substance, the polymer charge transfer substance and the like, on the surface of the charge transfer layer 201*f* or the charge generating layer 201*e*. More specifically, as the dispersing solvent of the binder resin, the low molecule charge transfer substance, the polymer charge transfer substance and the particle-like substance 201*c*, ketones such as methyl ethyl ketone, acetone, methyl isobutyl ketone, and cyclohexanone; ethers such as dioxane, tetrahydrofuran, ethylcellosolve and the like; aromatics such as toluene, xylene and the like; halogens such as chiorobenzene, dichloromethane and the like; esters such as ethyl acetate, butyl acetate and the like are used, and they are pulverized and dispersed using a ball mill, a sand mill, a vibration mill and the like.

As described above, the amount of the particle-like substance 201*c* added is 0.5 to 50% by weight and preferably 5 to 40% by weight. Further, the particle diameter of the particle-like substance 201*c* is 0.05 to 1.0 $\mu$m and preferably 0.05 to 0.8 $\mu$m. The thickness of a case of forming by lamination of the particle-like substance-containing surface layer 201*d* is 0.5 to 10 $\mu$m and preferably 0.5 to 5 $\mu$m.

As the coating method, an immersion method, a spray coating method, a ring coating method, a roll coater method, a gravure coating method, a nozzle coating method, a screen printing method and the like can be adopted.

Further, when the particle-like substance layer is provided on the low molecule charge transfer layer comprising the low molecule charge transfer substance and the binder resin, the structure of the binder resin which is used for the low molecule charge transfer layer is preferably different from the structure of the binder resin which is used for the particle-like substance layer. Thus, an interface is formed between the particle-like substance layer and the low molecule charge transfer layer, the diffusion of the particle-like substance 201*c* to the low molecule charge transfer layer is prevented, and the electric properties of the low molecule charge transfer layer is stabilized. Further, even if the binder resin has the same structure, solubility can differ when the structure of the low molecule charge transfer substance used differs, and thus, the diffusion prevention of the particle-like substance is possible. Thus, the stabilization of electric properties of the low molecule charge transfer layer and the particle-like substance 201*c* can be nearly and uniformly distributed in the layer by forming the interface between the particle-like substance layer and the low molecule charge transfer layer, therefore the high durability, high sensitivity and high stability of the photosensitizer 201 can be designed.

2. Charge generating layer 201*e*

The charge generating layer 201*e* is a layer in which the charge generating substance is a main component. Further, the binder resin may be used according to requirement.

[Charge generating substance]

As the charge generating substance, an inorganic-based material and an organic-based material can be used. As the inorganic-based material, crystalline selenium, amorphous selenium, selenium-tellurium, selenium-tellurium-halogen, selenium-arsine compound, amorphous silicon and the like can be mentioned. Concerning amorphous silicon, those in which dangling joints are terminated with a hydrogen atom and a halogen atom, and those in which a boron atom and a phosphorous atom and the like are doped are preferably used.

On the other hand, examples of the organic-based material include phthalocyanine-based pigments such as a metal phthalocyanine, a non-metal phthalocyanine and the like; azulenium salt pigments; squaric acid methine pigments; azo pigments having a carbazole skeleton; azo pigments having a diphenylamine skeleton; azo pigments having a dibenzothiophene skeleton; azo pigments having a oxadiazole skeleton; azo pigments having a bis (stilbene) skeleton; azo pigments having a distyryl carbazole skeleton; perylene-based pigments; antharquinone-based or polycyclic quinone-based pigments; quinoneimine-based pigments; diphenylmethane and triphenylmethane-based pigments; benzoquinone and naphthoquinone-based pigments; cyanine and azomethine-based pigments; indigoid-based pigments; bis(benzimidazole)-based pigments and the like. Further, these charge generating substances can be used alone or as a mixture of 2 or more thereof.

[Binder resin]

As the binder resin, for example, a polyamide, a polyurethane, anepoxyresin, apolyketone, apolycarbonate, a silicone resin, an acryl resin, a poly(vinyl butyral), a poly (vinyl ketone), a polystyrene, a poly(vinyl carbazole), a poly(acryl amide) and the like are used. These binder resins can be used alone or as a mixture of 2 or more thereof. Further, the low molecule charge transfer substance may be added according to requirement. Examples of a positive hole transfer substance include electron donative substances such as an oxazole derivative, an oxadiazole derivative, an imidazole derivative, a triphenylamine derivative, 9-(diethylaminostyrylanthracene), 1,1-bis(4-dibenzylaminophenyl)propane, styrylanthracene, styrylpyrazoline, phenylhydrazones, an α-phenyl stilbene derivative, a thiazole derivative, a triazole derivative, a phenazine derivative, an acridine derivative, a benzofuran derivative, a benzimidazole derivative, athiophene derivative and the like. Further, these positive hole transfer substances can be used alone or as a mixture of 2 or more thereof.

[Method of forming charge generating layer 201*e*]

The method of forming the charge generating layer 201*e* can be roughly divided in a vacuum thin film preparing method and a casting method from a solvent-diffused system. The latter method includes a vacuum deposition method, a glow discharge decomposition method, an ion plating method, a spattering method, method, a reactive spattering method, a CVD method. The charge generating layer 201*e* can be formed well using the inorganic-based material and organic-based material. Further, in the casting method described later, the charge generating layer 201*e* can be formed by dispersing the inorganic-based or organic-based charge generating material using a solvent such as tetrahydrofuran, cyclohexanone, dioxane, dichloroethane, butanone or the like (if necessary, together with the binder resin) by a ball mill, an a trighter, a sand mill and the like, appropriately diluting the dispersed solution and coating it. The coating of the dispersed solution can be carried out using an immersion coating method, a spray coating method, a bead coating method and the like. The film thickness of the charge generating layer 201*e* thus provided is 0.01 to about 5 μm and preferably 0.05 to 2 μm.

3. Charge transfer layer 201*f*

The charge transfer layer 201*f* is formed by dissolving the low molecule charge transfer substance as the charge transfer material, and the binder resin and coating it. As the binder resin of the charge transfer layer 201*f*, for example, a polycarbonate having good film property (a bisphenol A-type, a bisphenol Z-type, a bisphenol C-type, or a copolymer thereof), a polyarylate, a polysufone, a polyester, a methyl methacrylate resin, a polystyrene, a vinyl acetate resin, an epoxy resin, a phenoxy resin and the like can be used. Further, these binder resins can be used alone or as a mixture of 2 or more thereof.

On the other hand, as the low molecule charge transfer substance of the charge transfer layer 201*f*, for example, an oxazole derivative and an oxadiazole derivative (described in Japanese Patent Publications (Kokai) No. 52-139065 and No. 52-139066), an imidazole derivative and a triphenylamine derivative (described in Japanese Patent Application No. 1-77839), a benzidine derivative (described in Japanese Patent Publication (Koukoku) No. 58-32372), an α-phenyl stilbene derivative (described in Japanese Patent Publication (Kokai) No. 57-73075), a hydrazone derivative (described in Japanese Patent Publications (Kokai) No. 55-154955, No. 55-156954, No. 55-52063 and No. 56-81850 and the like), a triphenyl methane derivative (described in Japanese Patent Publication (Koukoku) No. 51-10983), an anthrathene derivative (described in Japanese Patent Publication (Kokai) No. 51-94829), a styryl derivative (described in Japanese Patent Publications (Kokai) No. 56-29245 and No. 58-198043), a carbazole derivative (described in Japanese Patent Publication (Kokai) No. 58-58552), a pyrene derivative (described in Japanese Patent Application No. 2-94812) and the like can be used.

Further, the charge transfer layer 201*f* is also a layer formed by dissolving the polymer charge transfer substance and coating it. As the polymer charge transfer substance, for example, a substance having a triarylamine which is indicated by the general formula (Formulae 12 to 21) in a main chain or a side chain, an acryl resin having a triarylamine skeleton described in Japanese Patent Publication (Kokai) Hei No. 5-202135, a poly(vinyl carbazole) and the like are used. Further, the addition of the low molecule charge transfer substance and an inert binder resin may be carried out to the charge transfer layer 201*f* using the polymer charge material, according to necessary.

The film thickness of the charge transfer layer 201*f* is appropriately about 5 to about 100 μm and preferably about 10 to about 40 μm. Further, a plasticizer and a leveling agent may be added in the charge transfer layer 201*f*. As the plasticizer, those such as dibutyl phthalate, dioctyl phthalate and the like used as the plasticizer of a general resin can be used as they are. The amount of the plasticizer used is appropriately 0 to 30 parts by weight per 100 parts by weight of the binder resin.

4. Electroconductive supporter 201*a*

As the material of the electroconductive supporter 201*a*, those indicating an electroconductivity of a volume resistance of $10^{10}$ Ωor less, for example, metals such as aluminum, nickel, chromium, Ni—Cr, copper, silver, gold, platinum, iron and the like; oxides such as stannic oxide, indium oxide and the like, etc. can be used. The electroconductive supporter 201*a* can be constituted by those obtained by coating the material on a film-like or cylindrical plastic, paper and the like by deposition or spattering, a tube obtained by making a rough tube by processes of extruding and extracting a board such as aluminum, aluminum alloy, nickel, stainless or the like, and then surface-treating it by shaving, finely finishing, polishing and the like.

Since the photosensitizer 201 which is described as above has the particle-like substance-containing surface layer 201*d* on its surface, the surface is guarded from a physical impact by a cleaning blade and the like, therefore it has a longer life time than a photosensitizer having no particle-like substance-containing surface layer 201*d*. Further, when this kind of photosensitizer leave the adherence of substances such as ion and the like caused by discharge of the electrification unit 202 and the like as it is, the shading of the image occurs in general. Accordingly, it is required to refresh the surface of the photosensitizer by shaving the surface to a certain degree by a cleaning blade.

The photosensitizer 201 of the present preferred embodiment is formed by a composition in which the surface is gradually shaved by a cleaning blade. Further, the surface layer of the photosensitizer 201, namely the particle-like substance-containing surface layer 201*d* is shaved and as a result, the particle-like substance 201*c* of the particle-like substance-containing surface layer 201*d* is made bare, therefore the particle-like substance 201*c* is designed to be naturally peeled off. Thus, a new surface layer is exposed on the surface of the image carrier, and the elongation of the life time of the image carrier and refresh effect are attained together.

5. Under-coating layer

Further, the photosensitizer 201 used in the present preferred embodiment may provide the under-coating layer which is shown below between the electroconductive supporter 201*a* and the photosensitive layer 201*b*. The under-coating layer is provided in order to improve the adhesion property, prevent Moire pattern and the like, improve the coating property of the upper layer, and reduce the residual electric potential, etc.

The under-coating layer has usually a resin as a main component, but the photosensitive layer 201*b* is coated with a solvent on these resins, therefore a resin having a higher solubility resistance against general solvents is desirable. Examples of the resin include water-soluble resins such as a polyvinyl alcohol, casein, a poly(sodium acrylate) and the like; alcohol-soluble resins such as a nylon copolymer, a methoxymethylated nylon and the like; curing-type resins which form three-dimensional network structure, such as a polyurethane, a melamine resin, an alkyd-melamine resin, an epoxy resin and the like, etc.

Further, for example, fine powders such as metal oxides which can be exemplified by titanium oxide, silica, alumina, zirconiumoxide, stannicoxide, indiumoxide, and the like, or metal sulfides, metal nitrides and the like may be added to the resins. These under-coating layers can be formed using an appropriate solvent and a coating method in like manner as the photosensitive layer 201*b*.

Further, as the under-coating layer, it is also useful to use a metal oxide layer which is formed, for example, by a sol-gel method and the like using a silane coupling agent, a titanium coupling agent, a chromium coupling agent, and the like. Further, in addition to the under-coating layer, a layer which is formed by providing $Al_2O_3$ by anode oxidization, and a layer which is formed by providing an organic product such as a poly(p-xylene) (parylene) or the like, or an inorganic product such as SiO, $SnO_2$, $TiO_2$, ITO, $CeO_2$ or the like by a vacuum thin film preparing method can be also used. The thickness of the under-coating layer is appropriately 0.1 to 10 μm.

6. Mono-layered photosensitive layer

Further, as described above, the photosensitizer 201 is not limited to the multi-layered structure, and for example, the mono-layered photosensitive layer (hereinafter, the photosensitizer 201 is referred to as 'mono-layered photosensitizer') which is shown below may be used.

The mono-layered photosensitive layer is formed by coating and drying a solution obtained by dissolving or dispersing the binder resin, the charge generating substance and the charge transfer substance, on the electroconductive substrate 201*a* using any one of the coating methods. As the constitution material of the mono-layered photosensitive layer, the binder resin, the charge generating substance, the low molecule charge transfer substance and the polymer charge transfer substance can be used. Further, the thickness of the mono-layered photosensitive layer is appropriately 5 to 100 μm and preferably 10 to 40 μm.

[Electrification unit 202]

The electrification unit 202 is an electrification unit for homogeneously electrifying on the photosensitizer 201, a contact electrification system using an electrification roller is used in the present preferred embodiment. The electrification roller of the electrification member has a basic constitution that an electroconductive rubber layer which is integrally and coaxially formed in a roller shape at a core metal and at the outer peripheral of the core metal is provided.

The both ends of the core metal are rotatably retained by bearing members and the like, and the electrification roller is pressured on the photosensitizer 201 at a fixed pressuring pressure by a pressuring unit which is not illustrated, and rotates while being in contact. In case of the electrification roller of the present preferred embodiment, it is constituted so as to be rotated in accordance with the rotational drive of the photosensitizer 201.

Further, the electrification roller is formed, for example, so that a medium resistance rubber layer having about 100KΩ•cm is coated on the core metal having a diameter of 9 mm and the diameter is 16 mm. Further, the core metal of the electrification roller is connected with a power source not illustrated. Then, when a fixed bias is put against the electrification roller from the power source, the peripheral face of the photo sensitizer 201 is uniformly electrified at a fixed electric potential of a fixed polarity.

[Developing unit 203]

The developing unit 203 is a unit in which it lets an electrified toner adhere against the latent image which is formed on the photosensitizer 201, and the toner image is formed on the photosensitizer 201. A two components-developing system is used in the present preferred embodiment. For example, as shown in FIG. 2, the developing roller 203*a* as a developing agent supporter is arranged in the developing unit 203 so as to be adjacently in contact with the photosensitizer 201, and a developing region is designed to be formed at the facing portion of the developing roller 203*a* and the photosensitizer 201.

The developing sleeve in which non magnetic body such as aluminum, brass, stainless, an electroconductive resin or the like is formed in a cylindrical shape is rotatably mounted on the roller surface, and the developing roller 203*a* is constituted to be rotated to clockwise direction by a rotational drive mechanism which abbreviated illustration.

Magnets such as a magnetic pole for forming magnetic field so as to erect the developing agent on the surface of the developing sleeve, and a magnetic pole for transferring the developing agent to the developing region or carrying out the developing agent from the developing region, and the like are provided in a fixed condition in the developing sleeve.

Further, in the developing unit 203, the doctor blade 203*b* for regulating the amount of the developing agent on the developing roller 203*a* is set at the upstream portion of the developing region in the transfer direction of the developing agent which is supported on the developing sleeve of the developing roller 203*a,* namely in the clockwise direction in FIG. 2.

Further, in the developing unit 203, the stirring screws 203*a* and 203*d* for scooping up the developing agent to the developing roller 203*a* side while stirring the developing agent in the developing casing are set at the back region of the developing roller 203*a*.

[Toner]

As described later, since the toner of the developing agent is fed from the outside of the engine units (imaging units) 2C, 2M, 2Y and 2K, it is unnecessary to have durability during the use time of the engine units (imaging units) 2C, 2M, 2Y and 2K. Accordingly, all type of toners suitable for the tow components-developing system can be used as the toner of the present preferred embodiment.

[Carrier]

In the present preferred embodiment, the carrier provided with a coating layer comprising a soft segment and a hard segment on the surface of a core material which comprising a magnetic substance is used. As a result of the research by the present applicant, the wear resistant coating layer which has elasticity is obtained, and it is found out that the carrier can absorbs a contact accompanied with an intensive impact to the coating layer which is caused by the friction with toner or the mutual friction of the carriers at stirring for electrifying the developing agent by friction.

Accordingly, the toner spent to the carrier can be suppressed by using the carriers having the constitution, the film shaving can be prevented, and the improvement effect of durability of the carrier is remarkable.

Wherein the soft segment means a soft phase or an elastic component in the coating layer of the carrier and has a action of absorbing impact. Further, the hard segment is a hard phase or a molecule binding component, and has a reinforcing effect.

As the method of providing the coating layer comprising the soft segment and the hard segment, for example, a method of crosslinking a thermosetting resin such as an acryl resin or the like with an amino resin or the like can be exemplified. As the thermosetting resin used here at, all of known thermosetting resins can be used. As the amino resin, a guanamine resin and a melamine resin can be used.

In the present preferred embodiment, a case of using the acryl resin as the thermosetting resin and the guanamine resin as the amino resin is illustrated below. As the acryl resin used hereat, all acryl resins can be used, and acryl resins having Tg of 20 to 100° C. are used, and those having Tg of 25 to 100° C. are preferably used. Namely, when Tg is less than 20° C., blocking property occurs at normal temperature, and preservation property is not preferably inferior. On the other hand, when Tg is more than 100° C., the resin of the coating layer is in an excessively hard condition, and elasticity is not obtained, therefore impact cannot be absorbed and an adequate improvement effect is not obtained.

Further, when the content of the guanamine resin is increased and decreased in a range of 20 to 50% by weight, the elasticity of the resin of the coating layer can be adjusted. Namely, when the content of the guanamine resin is less than 20% by weight, the improvement effect of wear resistance is not obtained because an adequate cross linking reaction does not occur. On the other hand, when it is more than 50% by weight, the crosslinking reaction with the acryl resin excessively proceeds, the resin of the coating layer becomes in a condition in which it is cured excessively, the elasticity is not obtained, therefore the impact cannot be absorbed and an adequate improvement effect is not obtained.

Further, either of an aromatic sulfonic acid or phosphoric acid as an electrification-adjusting agent may be used for the carrier. Thus, the crosslinking reaction with the guanamine resin becomes in a preferable condition, and the adjustment effect of the electrification of the carrier comes to be remarkable. As the electrification adjusting agent, carbon black or an acidic catalyst can be used alone or in combination, in addition to those mentioned above.

As the carbon black, all of carbon blacks which are generally used as the carrier or the toner can be used. Further, as the acidic catalyst, all of catalysts which have catalyst action can be used. For example, there are those having a reactive group such as a perfectly alkylated type, a methylol group type, an imino group type, a methylol/imino group type or the like, but it is not limited to these. Further, the carbon black can be used for an object as a resistance-adjusting agent.

Further, when the content of the electrification-adjusting agent is 10% by weight or less based on the guanamine resin, the improvement effect is remarkable. Namely, when the electrification-adjusting agent is more than 10% by weight, the reaction with the guanamine resin excessively proceeds, the adequate crosslinking reaction of the guanamine resin with the acryl resin does not occur, therefore there occurs a problem that the improvement effect of wear resistance is not adequately obtained.

Further, in the production process of the carrier, when the various conditions are satisfied, Et remarkable improvement effect is obtained. Specifically, when the electrification-adjusting agent is contained in the production process of the carrier, the crosslinking reaction with the resin, therefore the occurrence of coagulation at production can be suppressed, carrier having weak coagulation property is obtained, and pulverization becomes easy and yield is improved. However, as described above, it is required that the content of the electrification-adjusting agent is 10% by weight or less based on the guanamine resin. When the electrification-adjusting agent is more than 10% by weight, the reaction with guanamine resin excessively proceeds, the adequate crosslinking reaction of the guanamine resin with the acryl resin does not occur, therefore there occurs a problem that the improvement effect of wear resistance is not adequately obtained.

Further, particles in which the primary particle diameter or the secondary particle diameter of the carrier is larger than the thickness of the coating layer may be contained in the coating layer. Since the particle becomes convex as compared with the coating film in the carrier having such constitution, a contact accompanied with an intensive impact to the coating resin by the friction with toner or the mutual friction of the carriers which is caused by stirring for electrifying the developing agent by friction can be mitigated.

Further, the toner spent to the carrier can be prevented thereby, the film shaving of the coating resin which is the spot of electrification occurrence can be prevented, and improvement effect is remarkable. Wherein when the particle is smaller than the thickness of the coating layer, the particle is buried in the coating resin, therefore effect is remarkably lowered. Further, when the particle is larger than 10-fold of the thickness of the coating layer, the contact area of the particle with the coating resin is little, therefore an adequate adhesive force is not obtained, and the particle is easily separated.

Further, the content of the particle is 20 to 80% by weight based on the coating resin, and preferably 30 to 70% by weight. Namely, when the content of the particle is less than 20% by weight, the proportion of the particle which occupies is little as compared with the proportion of the coating resin at the surface of the carrier, therefore a contact accompanied with an intensive impact to the coating resin is not obtained adequately. Further, when the content of the particle is more than 80% by weight, the proportion of the particle which occupies is too much as compared with the proportion of the coating resin on the surface of the carrier, therefore the proportion of the coating resin which is the spot of electrification occurrence is inadequate and an adequate electrification ability is not obtained.

Further, as the particle used hereto, for example, when alumina, titanium oxide, zinc oxide, barium titanate, iron oxide, barium sulfate and the like are used, a remarkable improvement effect is obtained, but it is not limited to these. Further, as the carrier of the present preferred embodiment, the carrier whose surface is covered with an electrically low resistance substance can be used. Since the particle surface is electrically low resistance for the carrier, excessive toner electrification is suppressed, the electrified charge of the contact area is easily transferred to the surface of the carrier, it contributes to the improvement of charge exchange property and electrification speed, and even if the toner and the like adhere on the surface of the carrier to a certain degree, it does not induce an abrupt lowering of electrification amount, therefore the improvement effect is remarkable.

[Specific example of carrier]

As the carrier of the present preferred embodiment, it is desirable in particular that conditions below are provided. Of course, the carrier of the present preferred embodiment is not limited to only the carrier which is provided with various conditions below.

As the carrier of the present preferred embodiment, for example, 167 parts of an acryl resin solution [solid content: 50% by weight (HITALOID manufactured by Hitachi Chemical Co., Ltd.)], 19 parts of a guanamine resin solution [solid content: 77% by weight (MYCOAT manufactured by Mitsui Scitec Co., Ltd.)], 400 parts of toluene, and 400 parts of butyl cellosolve are dispersed by a homomixer for 10 minutes to prepare a resin coating-forming solution. Further, the resin solution is coated on the surface of a core material by SPIRACOATER (manufactured by OKADA Seikou Co., Ltd.) so as to be a thickness of 0.15 $\mu$m, using a calcinated ferrite powder [F-300: mean particle diameter; 50 $\mu$m (manufactured by POWDERTEC Co., Ltd.)] as the core material. The carrier thus obtained is left alone at 150° C. for one hour in an electric furnace and calcinated. Then, after cooling, it is pulverized using a sieve of 100 $\mu$m mesh to obtain the carrier.

[Example of other carrier]

As the coating layer comprising the soft segment and the hard segment, there may be a resin prepared by an organic compound (A) in which the main component of the coating resin has a functional group (provided that a $Si(OR_1)$ group is excluded ($R_1$ represents a hydrogen atom, a lower alkyl group, or an acyl group)), a compound (B) having a functional group which can react with the functional group which the organic compound (A) has, and a $Si(OR_1)$ group ($R_1$ has the same meaning as mentioned above), and/or a hydrolyzed condensed product thereof, and an organo silicone compound (C) indicated by the under-mentioned general formula and/or a hydrolyzed condensed product thereof. In this case, (A) is the soft segment, (C) is the hard segment, and (B) functions as the binder.

$$Si(OR_2)_4$$

(in the general formula, $R_2$ may be the same or different, and represents a hydrogen atom, a lower alkyl group, or an acyl group)

[Cleaning unit 204]

The cleaning unit 204 is a unit for transferring the toner image which is formed on the photosensitizer 201, on a transfer such as a transfer paper, OHP sheet or the like, or an intermediate transfer body, and then eliminating the residual toner which remained on the photosensitizer 201. For example, as shown in FIG. 2, the cleaning unit 204 has the cleaning blade 204*a* for shaving the residual toner on the photosensitizer 201, and the waste toner-discharging screw 204*b* for discharging the residual toner which is shaved by the cleaning blade 204*a* in waste toner storing containers as the waste toner-storing unit not illustrated which are provided at the outside of the engine units (imaging units) 2C, 2M, 2Y and 2K.

[Motion of engine units (imaging units) 2C, 2M, 2Y and 2K]

Then, the motion of engine units (imaging units) 2C, 2M, 2Y and 2K is illustrated. In FIG. 1 and FIG. 2, the photosensitizer 201 continues to rotate to the anti-clockwise direction at forming the image. Firstly, a fixed bias is impressed from a power source not illustrated against the electrification unit 202. Thus, the surface of the photosensitizer 201 is uniformly and negatively electrified at an electrical potential of about −600 [V]

Then, write light is irradiated from each LED arrays 3C, 3M, 3Y and 3K through the opening parts 208 against the photosensitizer 201 thus electrified. Positive holes are generated at the charge generating layer 201*e* of the photosensitizer 201 thereby, and the positive holes which are generated pass the charge transfer layer 201*f* and the particle-like substance-containing surface layer 201*d* and reach to the surface of the photosensitizer 201.

Then, when the positive holes reach to the surface of the photosensitizer 201, the electrification potential of the portion to which the positive holes reached is raised to about −100 [V] by the action of the positive holes, and as a result, a static latent image is formed on the photosensitizer 201 in accordance with the write light. Namely, in the present preferred embodiment, the latent image of the portion to which the write light is irradiated, on the photosensitizer 201 becomes the image portion, and the other portion is non image part.

On the other hand, in the developing units 203, the two component-developing agents are scooped up on the developing rollers 203*a* by the action of the rotation of the developing sleeves and the transfer magnetic poles. Then, the two component-developing agent which is scooped up on the developing rollers 203*a* is carried to the developing region which is the facing portion of the photosensitizer 201 and the developing units 203 by the doctor blade 203*b* while the film thickness is controlled.

The carrier which constitutes the developing agent is erected in a chain shape on the developing sleeve along magnetic line of force which is emitted from the developing magnetic pole at the inside of the developing rollers 203*a*, the electrified toner is adhered on the carrier which is erected in a chain shape, and magnetic brash is formed. The magnetic brash formed is transferred to the same direction as the developing sleeve, namely to a clockwise direction in accordance with the rotational transfer of the developing sleeve.

On the other hand, the two component-developing agent which is discharged from the developing region is stirred again by the stirring screws 203*c* and 203*d* in the casing of the developing units 203, and the toner of the two component-developing agent is brought in contact with the carrier and appropriately electrified.

Since the carrier of the present preferred embodiment is carrier provided with the coating layer comprising the soft segment and the hard segment as described above, it is prevented that the coating layer is peeled by the contact with the toner and the contact with the mutual carriers. Accordingly, in the carrier of the present preferred embodiment, the coating layer is hardly peeled and the toner spent hardly occurs. Thus, the carrier can keep the electrification property for a long term, and the elongation of life time of the engine units (imaging units) 2C, 2M, 2Y and 2K is designed.

When the latent image which is formed as described above reaches to the developing region which is the facing portion of the photosensitizer 201 and the developing units 203, the magnetic brash which is erected is brought in contact with the photosensitizer 201.

The electrical potential value which is intermediate between the electrical potential value of the latent image and the electrical potential value of non image part is impressed on the developing rollers 203*a* of the developing units 203 by a power source not illustrated. Thus, the negatively electrified toner which is contained in the magnetic brash is pulled to the image part of the static latent image, and separated from non image part. As a result, the toner is adhered only on the image part of the static latent image, and the toner image is formed. Further, as the voltage which is impressed to the developing rollers 203*a,* an alternate voltage can be also adopted.

The toner image thus formed is transferred on the intermediate transfer belt 8 at the contact part of the photosensitizer 201 with the intermediate transfer belt 8. At this time, the residual toner which remained on the photosensitizer 201 without being transferred on the intermediate transfer belt 8 is physically shaved at a fixed pressure by the cleaning blade 204*a* of the cleaning unit 204 which is brought in contact with the photosensitizer 201.

The residual toner which is shaved off by the cleaning blade 204*a* is peeled from the cleaning blade 204*a*, and stored once in the casing of the cleaning unit 204. Then, the residual toner which is stored once in the casing of the cleaning unit 204 is discharged by the waste toner-discharging screw 204*b* in waste toner storing containers as the waste toner-storing unit which are provided at the outside of the engine units (imaging units) 2C, 2M, 2Y and 2K.

Since the photosensitizer 201 of the present preferred embodiment has the particle-like substance-containing surface layer 201*d* on its surface, it can control the degree at which the photosensitizer 201 is worn when the residual toner is shaved off by the cleaning blade 204*a*. Accordingly, the worn degree of the photosensitizer 201 can be reduced, and the elongation of life time of the engine units (imaging units) 2C, 2M, 2Y and 2K is designed.

[Conception of long life engine units (imaging units)]

As described above, the unit for elongating the life time is carried out for the engine units (imaging units) 2C, 2M, 2Y and 2K of the present preferred embodiment. In the image forming apparatus using the engine units (imaging units) 2C, 2M, 2Y and 2K, the life time of the engine units (imaging units) 2C, 2M, 2Y and 2K approaches the life time of the main body (which indicates the part excluding the engine units (imaging units) 2C, 2M, 2Y and 2K from the image forming apparatus. Hereinafter, it is the same) of the image forming apparatus. There are a case of being longer than the life time of the main body of the image forming apparatus, and a case of being longer than the rental term of the image forming apparatus and use term. Then, it becomes a great merit to reuse the engine units (imaging units) 2C, 2M, 2Y and 2K. Heart, when each engine units (imaging units) 2C, 2M, 2Y and 2K are individually detachable, the management of the engine units (imaging units) 2C, 2M, 2Y and 2K which are collected from various image forming apparatus becomes a load.

Specifically, since the term in which they are used until the collection of the imaging units is different by every image forming apparatus, the life time of the imaging unit which is collected from a certain image forming apparatus differs from the life time of the imaging unit which is collected from another image forming apparatus. Then, when the imaging units which have extremely different life time are reused each other in the same machine, the maintenance is required at every time when the life time of each imaging units is terminated, therefore the maintenance cost becomes great. In order to evade the problem, the management must be carried out so as to reuse the imaging units which have nearly the same residual life time in the same image forming apparatus. However, the information of the combination of the imaging units which have nearly the same residual life time must be managed in order to carry out the management, and this is a load for a maker side.

Accordingly, in the present invention, a plurality of the imaging units which are used in one image forming apparatus are constituted as an integrated unit, and the unit is exchanged. By using such constitution, the imaging units which have nearly the same life time can be reused always in combination without managing the residual life time by every imaging unit. Of course, even the imaging units which are used for the same term differ really in frequency in use by every color, and the residual life time is not coincided perfectly between the imaging units which constitute the same unit. However, the difference of the life times of each imaging units of the same image forming apparatus is not so large as compared with the difference of the residual life times according to the difference of use term of the image forming apparatus. Further, there is a merit that the cost of managing the residual life times by every imaging unit does not occur. The mechanism in which a plurality of the imaging units (engine units (imaging units) 2C, 2M, 2Y and 2K) are constituted as an integrated unit described below.

[Fixation mechanism and attachment and detachment mechanism of long life engine units (imaging units)]

The mechanism for fixing the engine units (imaging units) 2C, 2M, 2Y and 2K in the main body of the image forming apparatus is described below.

Figure 4:
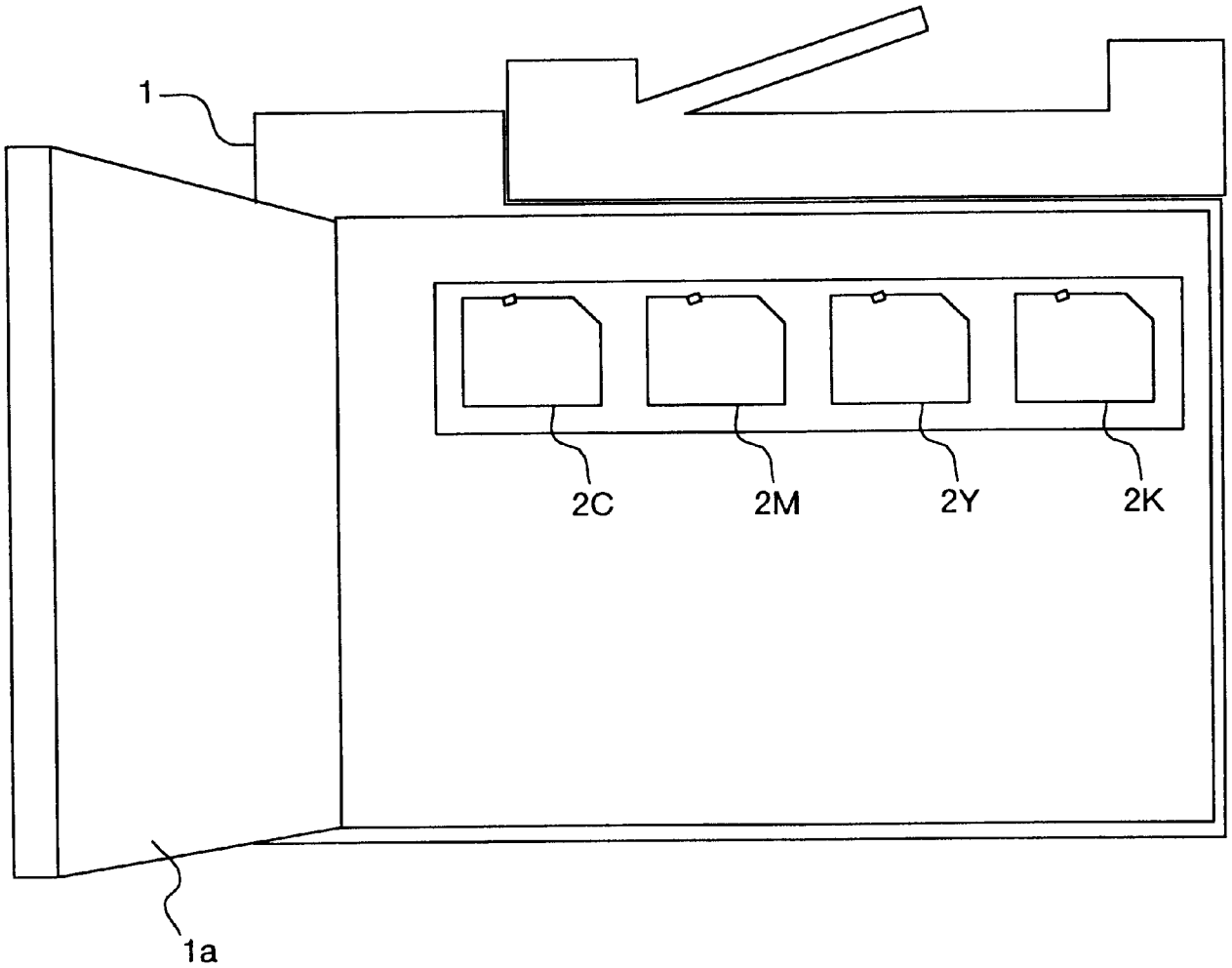
FIG. 4 is a schematic frontal view showing a condition in which a door which is provided at frontal face of the engine units is opened.

A condition in which a door la which is provided in front of the image forming apparatus is opened is shown in FIG. 4. The door 1*a* is provided for exchanging each engine unit (imaging units) 2C, 2M, 2Y and 2K and repairing the jam of the recording paper, and the like. In FIG. 4, when the door 1*a* is opened, four of each engine unit (imaging units) 2C, 2M, 2Y and 2K are exposed in an arranged condition as described.

Figure 5:
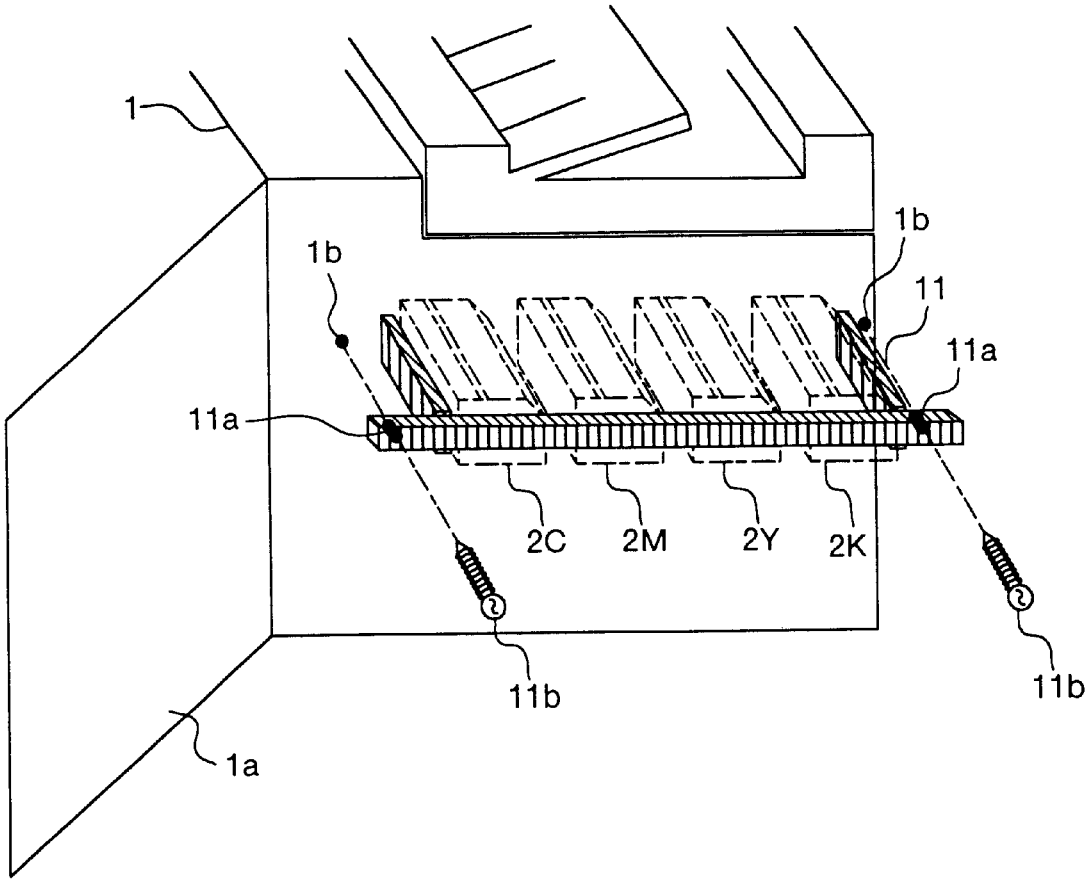
FIG. 5 is a schematic cross-eyed view showing a condition in which a door which is provided at frontal face of the engine units is opened and the engine unit is attached to and detached from the main body of an image forming apparatus.

A shown in FIG. 5, each engine unit (imaging units) 2C, 2M, 2Y and 2K have the constitution in which they are supported by the supporting member 11, constitutes an integrated unit, and the four of each engine units (imaging units) 2C, 2M, 2Y and 2K and the supporting member 11 are integrally attached and detached. Further, two screw holes 11*a* are provided at both ends of the supporting member 11. When two screws 11*b* are inserted in these screw holes 11*a* and each screws 11*b* are spirally fit in each screw holes 11*a* which are located in front of the main body of the image forming apparatus, the supporting member 11 is designed to be fixed in front of the main body of the image forming apparatus.

Figure 6:
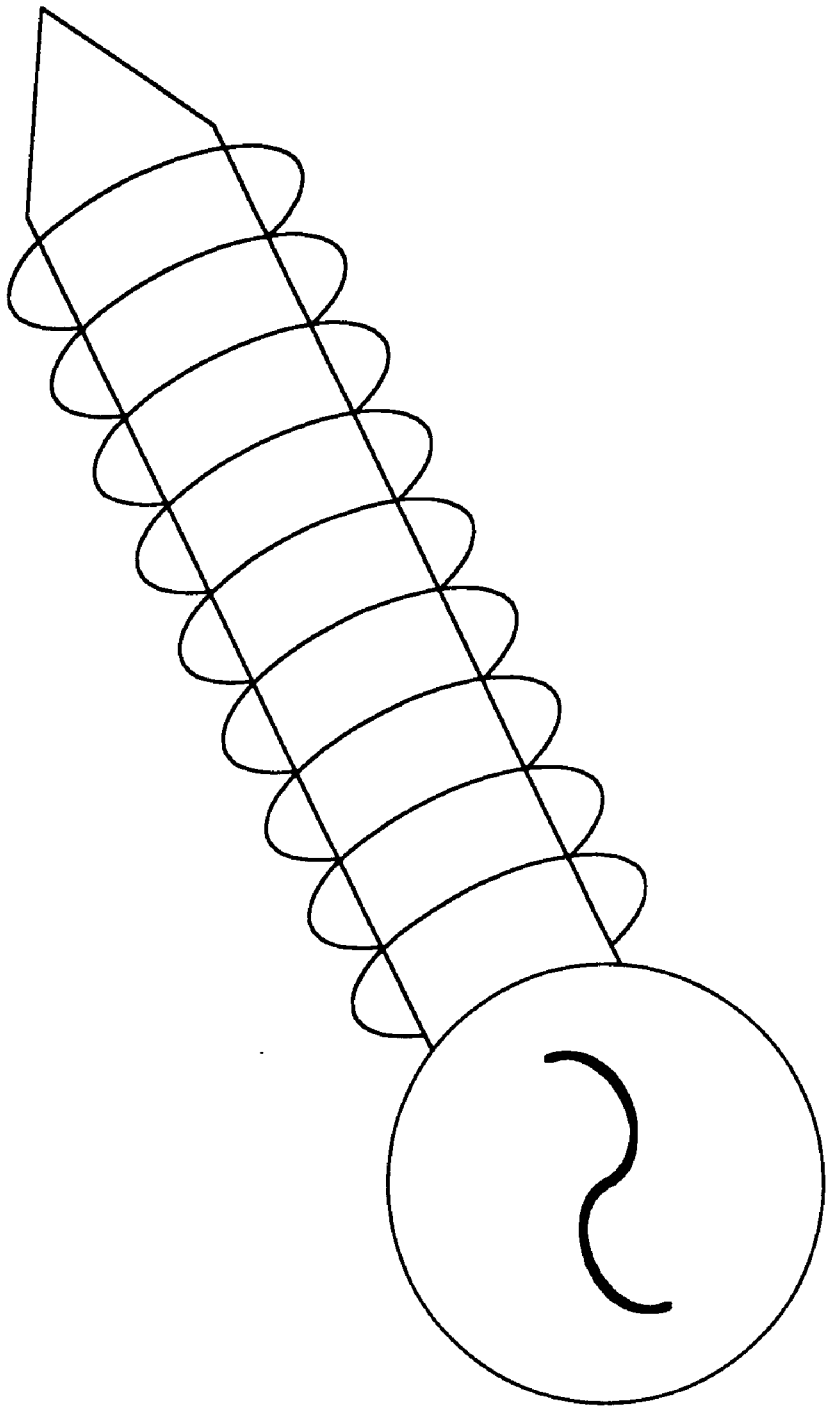
FIG. 6 is a schematic cross-eyed view showing one example of a screw which is used for the attachment and detachment of a supporting member for fixing the engine units against the main body of an image forming apparatus.

The screws 11*b* used here are not a plus screw and a minus screw which are usually used, and as shown in FIG. 6, the driver hole is formed in a S-character shape curve form. Namely, the screws 11*b* is attachable to only when a specific driver corresponding to the screws 11*b* which is permitted to the service man who is authorized by a maker is used, and are formed so as not to be attached and detached by a commercially available usual driver other than it. Namely, they are provided by enhancing the difficulty in case of detachment so that a user cannot easily be detached.

Figure 7:
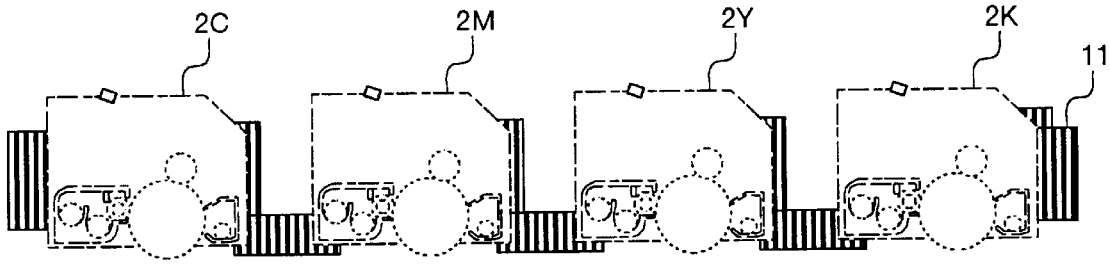
FIG. 7 is a schematic frontal view of the supporting member which is viewed from the front direction of the image forming apparatus.
Figure 8:
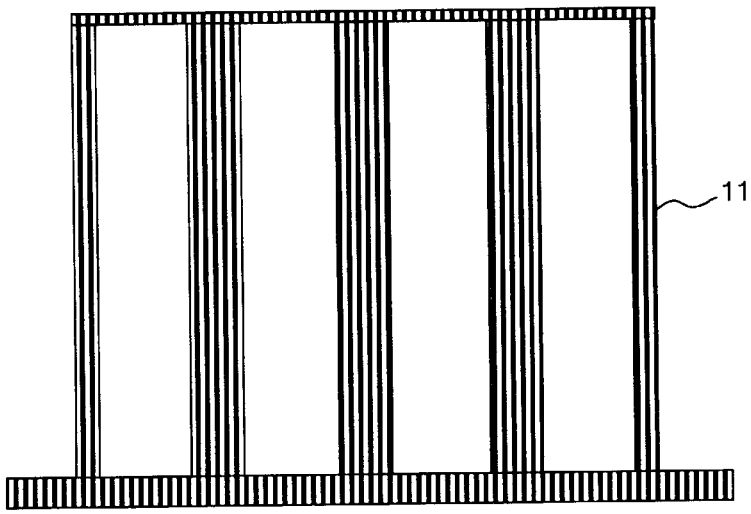
FIG. 8 is a schematic plan view of the supporting member which is viewed from the upper direction of the image forming apparatus.

Then, the constitution of the support member 11. In FIG. 7, a schematic frontal view of the supporting member 11 which is viewed from the front direction of the image forming apparatus 1 is shown. In FIG. 8, a plan view of the supporting member 11 which is viewed from the upper direction of the image forming apparatus 1 is shown. As shown in FIG. 7 and FIG. 8, the supporting member 11 is formed in a form for supporting both sides of each engine unit (imaging units) 2C, 2M, 2Y and 2K. Thus, when the image is formed, the photosensitizer 201 which is in a condition in which it is supported by the supporting member 11 can be brought in contact with the intermediate transfer belt 8.

Further, as shown in FIG. 7, the supporting member 11 has a form of pressing the upper part of each engine unit (imaging units) 2C, 2M, 2Y and 2K while supporting the lower part, and sandwiches each engine unit (imaging units) 2C, 2M, 2Y and 2K from up and down. By making the supporting member 11 as such, each engine unit (imaging units) 2C, 2M, 2Y and 2K and the supporting member 11 are formed as an integrated unit. As described above, since each engine unit (imaging unit) 2C, 2M, 2Y and 2K is made as an integrated structure, each engine unit (imaging units) 2C, 2M, 2Y and 2K which has nearly the same residual life time can be easily and simultaneously reused.

Figure 9:
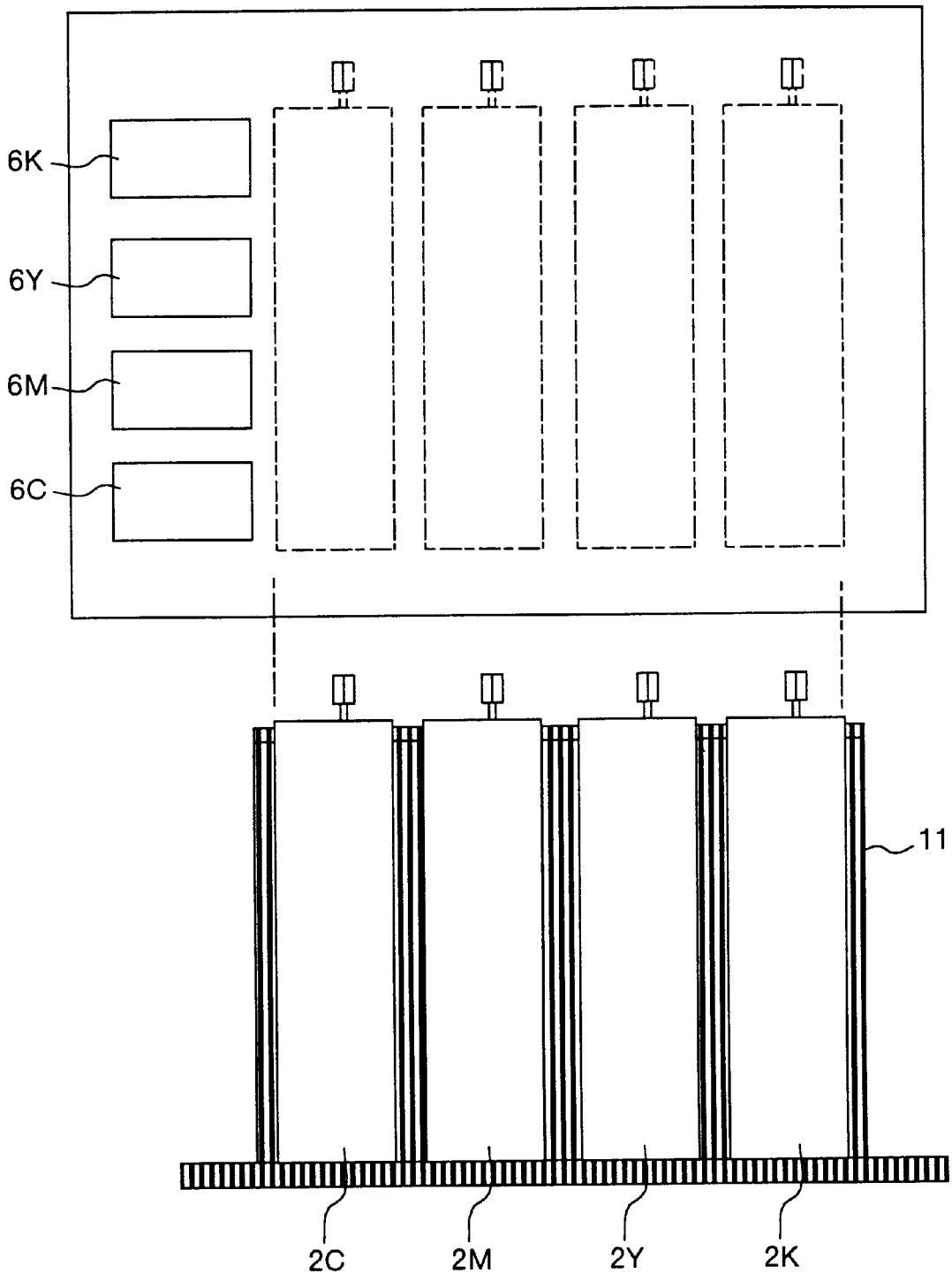
FIG. 9 is a schematic plan view showing a condition in which the engine units are detached from the main body of an image forming apparatus.

Further, as shown in FIG. 9, when each engine unit (imaging units) 2C, 2M, 2Y and 2K is detached, the four engine units (imaging units) 2C, 2M, 2Y and 2K and the supporting member 11 are simultaneously detached from the main body of the image forming apparatus as an integrated unit. Each engine unit (imaging units) 2C, 2M, 2Y and 2K has a constitution that they pull out the supporting member 11 and at the same time, and the connection with the drive mechanism and the like of the main body of the image forming apparatus is designed to be detached. The detail of the constitution is described below.

Figure 10:
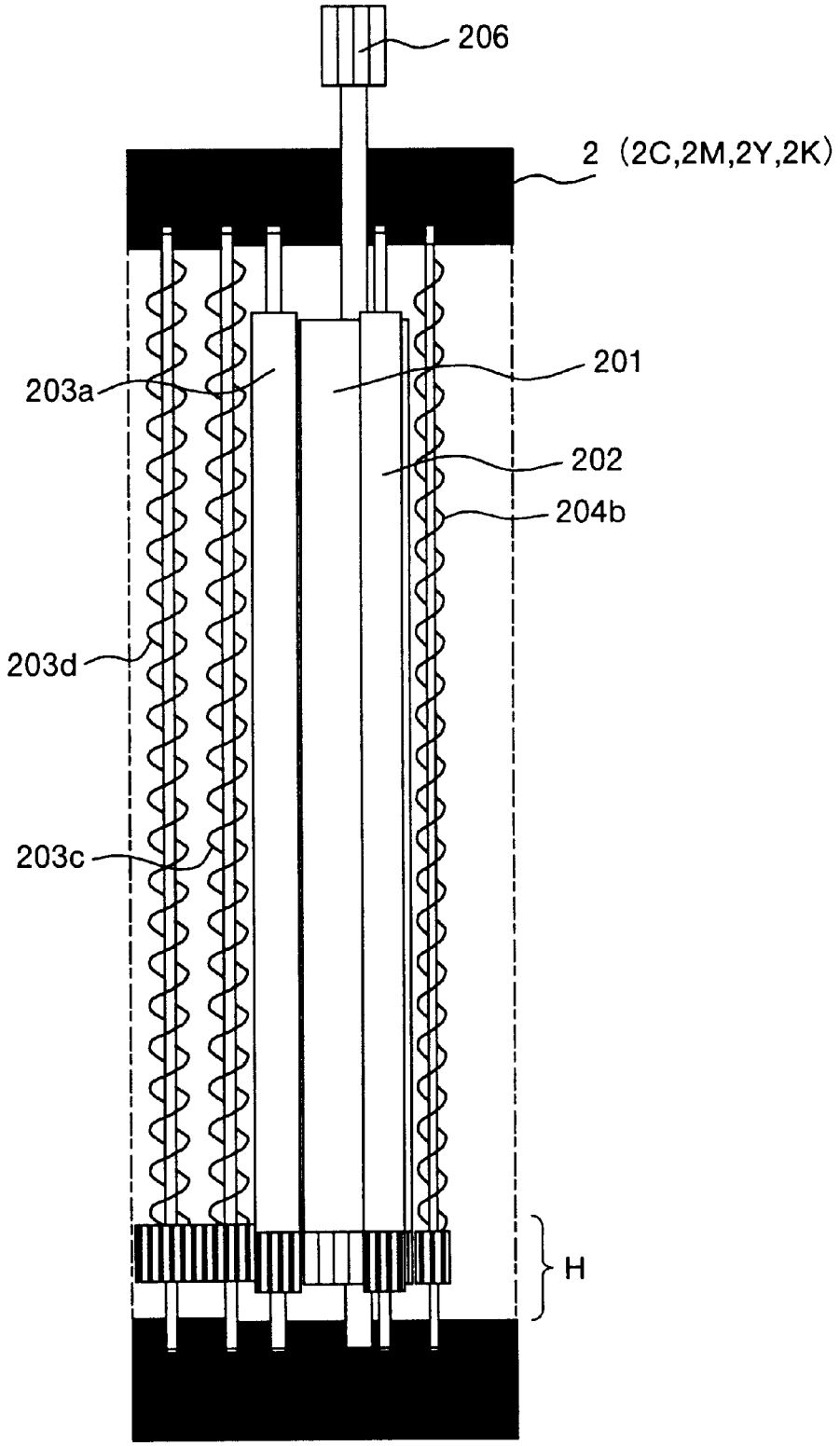
FIG. 10 is a schematic plan view showing the inner structure of the engine units.

In FIG. 10, the inner structure of the engine units (imaging units) 2C, 2M, 2Y and 2K is shown. In FIG. 10, the driving force for driving each imaging unit in each engine unit (imaging units) 2C, 2M, 2Y and 2K is transmitted from a motor not illustrated which is provided in the main body of the image forming apparatus through the gear 206 which is provided at the end part of the rotational shaft of the photosensitizer 201. The drive transmission from the photosensitizer 201 which is rotated through the gear 206 to other imaging units is carried out by that the gears which are formed at other end part of the photosensitizer 201 are directly geared with gears which are provided at end parts of the electrification units 202, the developing rollers 203*a*, the stirring screws 203*c* and 203*d*, and the waste toner-discharging screw 204*b* which are other imaging units, at the H region of FIG. 10.

Figure 11:
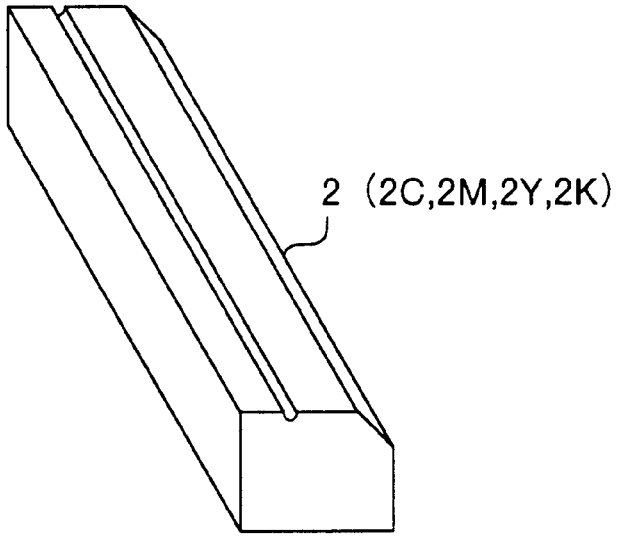
FIG. 11 is a schematic cross-eyed view of the engine units which are viewed from the frontal upper direction of the image forming apparatus.
Figure 12:
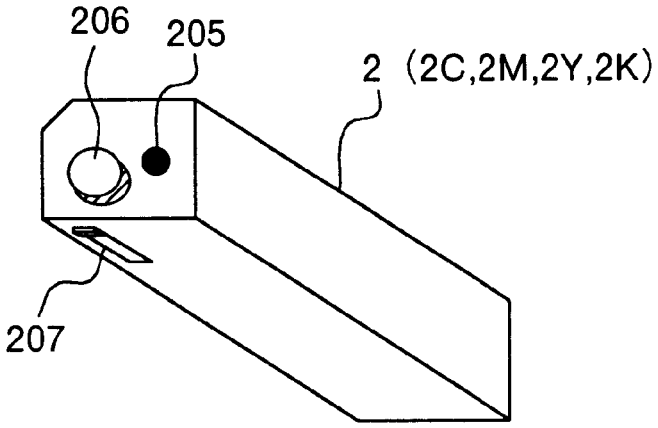
FIG. 12 is a schematic cross-eyed view of each engine units which are viewed from the back lower direction of the image forming apparatus.

In FIG. 11, a schematic cross-eyed view of each engine unit (imaging units) 2C, 2M, 2Y and 2K which is viewed from the frontal upper direction of the image forming apparatus is shown. In FIG. 12, a schematic cross-eyed view of each engine unit (imaging units) 2C, 2M, 2Y and 2K which is viewed from the back lower direction of the image forming apparatus is shown. As cleared from FIG. 11 and FIG. 12, each engine unit (imaging units) 2C, 2M, 2Y and 2K is constituted so that each imaging unit and the drive transmission do not externally appear when they are viewed from the frontal direction of the image forming apparatus. On the other hand, when they are viewed from the back direction of the image forming apparatus, only the gear 206, the elastic member 205 described later, and the shutter mechanism 207 are constituted to appear.

Namely, when each engine unit (imaging units) 2C, 2M, 2Y and 2K is attached in the main body of the image forming apparatus, it is constituted that the image formation can be carried out by linking each engine units (imaging units) 2C, 2M, 2Y and 2K with the main body of the image forming apparatus through the gear 206, the elastic member 205, and the shutter mechanism 207.

In FIG. 13(*a*), (*b*) and (*c*), a mechanism which links each engine units (imaging units) 2C, 2M, 2Y and 2K with the main body of the image forming apparatus through the gear 206, the elastic member 205, and the shutter mechanism 207 is shown.

FIGS. 13(*a*) and (*b*) are schematic section views in which each engine units (imaging units) 2C, 2M, 2Y and 2K are viewed from the side face of the image forming apparatus. FIG. 13(*c*) is a schematic frontal view of each engine units (imaging units) 2C, 2M, 2Y and 2K. Further, FIGS. 13(*a*) and (*c*) are drawn being horizontally arranged in a row in order to show the correspondence of the schematic section view with the schematic frontal view of each engine units (imaging units) 2C, 2M, 2Y and 2K.

In FIGS. 13(*a*) and (*b*), the elastic member 205 is constituted by a rubber member which is notched. The pipe 609 for introducing the toner in the casing of the developing unit 203 through the elastic member 205 is inserted in the inner part of each engine units (imaging units) 2C, 2M, 2Y and 2K. Wherein in a condition in which the pipe 609 is inserted in the inner part of each engine units (imaging units) 2C, 2M, 2Y and 2K, the elastic member 205 is opened to the inner part of each engine units (imaging units) 2C, 2M, 2Y and 2K. Further, in a condition in which the pipe 609 is not inserted in the inner part of each engine units (imaging units) 2C, 2M, 2Y and 2K, the elastic member 205 blocks the insertion passage of the pipe 609, and achieves a role of a valve for not leaking the toner which is stored in the developing unit 203 of the inner part of the engine units (imaging units) 2C, 2M, 2Y and 2K to outside.

Thus, since it is constituted that the toner is fed from the outside of each engine units (imaging units) 2C, 2M, 2Y and 2K, it is unnecessary to detach each engine units (imaging units) 2C, 2M, 2Y and 2K from the image forming apparatus, only to feed the toner. Accordingly, thus, a constitution of externally feeding the toner is preferable for using each engine units (imaging units) 2C, 2M, 2Y and 2K for a long time.

Further, the shutter mechanism 207 is constituted by the L-character type member 207*a* and the energizing spring 207*b*. Wherein when each engine units (imaging units) 2C, 2M, 2Y and 2K are attached in the image forming apparatus, the L-character type member 207*a* moves to the right side of the drawing, opposing the elastic force of the energizing spring 207*b* as shown in FIG. 13(*a*). Thus, the taking-out nozzle for discharging the waste toner by the waste toner-discharging screw 204*b* to the outside of each engine units (imaging units) 2C, 2M, 2Y and 2K is released.

On the other hand, when each engine units (imaging units) 2C, 2M, 2Y and 2K is detached from the image forming apparatus, the L-character type member 207*a* moves to the left side of the drawing by the elastic force of the energizing spring 207*b* as shown in FIG. 13(*b*). Thus, the taking-out nozzle of the waste toner is blocked so that the waste toner is not spilled out from each engine units (imaging units) 2C, 2M, 2Y and 2K are released.

Thus, since it is constituted that the each waste toner is discharged to the outside of each engine units (imaging units) 2C, 2M, 2Y and 2K, the waste toner is not accumulated in the inner part of each engine units (imaging units) 2C, 2M, 2Y and 2K. Accordingly, it is unnecessary to detach each engine units (imaging units) 2C, 2M, 2Y and 2K from the image forming apparatus, only to feed the toner, and each engine units (imaging units) 2C, 2M, 2Y and 2K can be continuously used over a long time.

The waste toner-storing part can be provided in each engine units (imaging units) 2C, 2M, 2Y and 2K, but when the constitution is used, a gigantic waste toner-storing part is required for continuously using the long life engine units (imaging units) 2C, 2M, 2Y and 2K, and it is not preferable to induce to make each engine units (imaging units) 2C, 2M, 2Y and 2K in large scale.

Further, as a method of taking out the waste toner without providing a constitution of discharging the waste toner to the outside of each engine units (imaging units) 2C, 2M, 2Y and 2K and without making each engine units (imaging units) 2C, 2M, 2Y and 2K in large scale, the development of a technology for transferring 100% of the toner image on the photosensitizer 201, and the development of a technology for reabsorbing the remaining residual toner in the developing unit 203, and the like can be considered.

Under the condition shown in FIG. 13(*a*), each engine units (imaging units) 2C, 2M, 2Y and 2K are attached in the image forming apparatus, and in a condition in which the image can be formed. Under the condition, the gear 206 which is provided at each engine units (imaging units) 2C, 2M, 2Y and 2K sides is directly geared with the drive gear 12*a* which is provided at the main body of the image forming apparatus. Thus, the driving force not illustrated which is provided in the image forming apparatus comes to be able to be transmitted to the gears 206 of each engine units (imaging units) 2C, 2M, 2Y and 2K through the drive gear 12*a*.

Further, under the condition, the 209 is inserted in the inner part of each engine units (imaging units) 2C, 2M, 2Y and 2K while opening the elastic member 205 to inside, and the toner can be fed by the toner feeding mechanism described later.

Further, under the condition, the L-character type member 207*a* moves to a direction of compressing the energizing spring 207*b* by the convex part 12*b* which is provided in the image forming apparatus, the taking-out nozzle of the waste toner is released. Thus, the waste toner is designed to be able to be discharged in the waste toner-storing part.

On the other hand, under the condition shown in FIG. 13(*b*), each engine units (imaging units) 2C, 2M, 2Y and 2K are detached from the image forming apparatus, and in a condition in which the image cannot be formed. At this time, the gears 206 of each engine units (imaging units) are not geared with the drive gear 12*a*, and the driving force of a motor not illustrated which is provided in the main body of the image forming apparatus is designed not to be transmitted.

Further, under this condition, the pipes 609 are not inserted in the inner parts of each engine units (imaging units) 2C, 2M, 2Y and 2K, the elastic members 205 are closed, the toner is designed not to be leaked out from each engine units (imaging units) 2C, 2M, 2Y and 2K. Further, under this condition, as described above, the L-character type member 207*a* moves to a direction of closing the taking-out nozzle of the waste toner by the elastic force of the energizing spring 207*b*. Thus, the outflow of the waste toner from each engine units (imaging units) 2C, 2M, 2Y and 2K is prevented.

According to the constitution, the each engine units (imaging units) 2C, 2M, 2Y and 2K of the present preferred embodiment pull out the supporting member 11 from the image forming apparatus, and each engine units (imaging units) 2C, 2M, 2Y and 2K can be easily separated from the main body of the image forming apparatus. Further, when the supporting member 11 is inserted in the image forming apparatus, each engine units (imaging units) 2C, 2M, 2Y and 2K can be easily linked with the main body of the image forming apparatus.

Accordingly, when each engine units (imaging units) 2C, 2M, 2Y and 2K are detached from the image forming apparatus, no other working other than taking out each screws 11*b* as the fixation unit is required, therefore operationability is better. The toner for supply is fed from the outside of each engine units (imaging units) 2C, 2M, 2Y and 2K, the waste toner is discharged out to the outside of each engine units (imaging units) 2C, 2M, 2Y and 2K, therefore before the lifetimes of each engine units (imaging units) 2C, 2M, 2Y and 2K are terminated, there is no possibility of no use because the toners in the inner part of each engine units (imaging units) 2C, 2M, 2Y and 2K are exhausted and the waste toner is filled up in the inner part of each engine units (imaging units) 2C, 2M, 2Y and 2K.

[Toner feeding unit]

Figure 14:
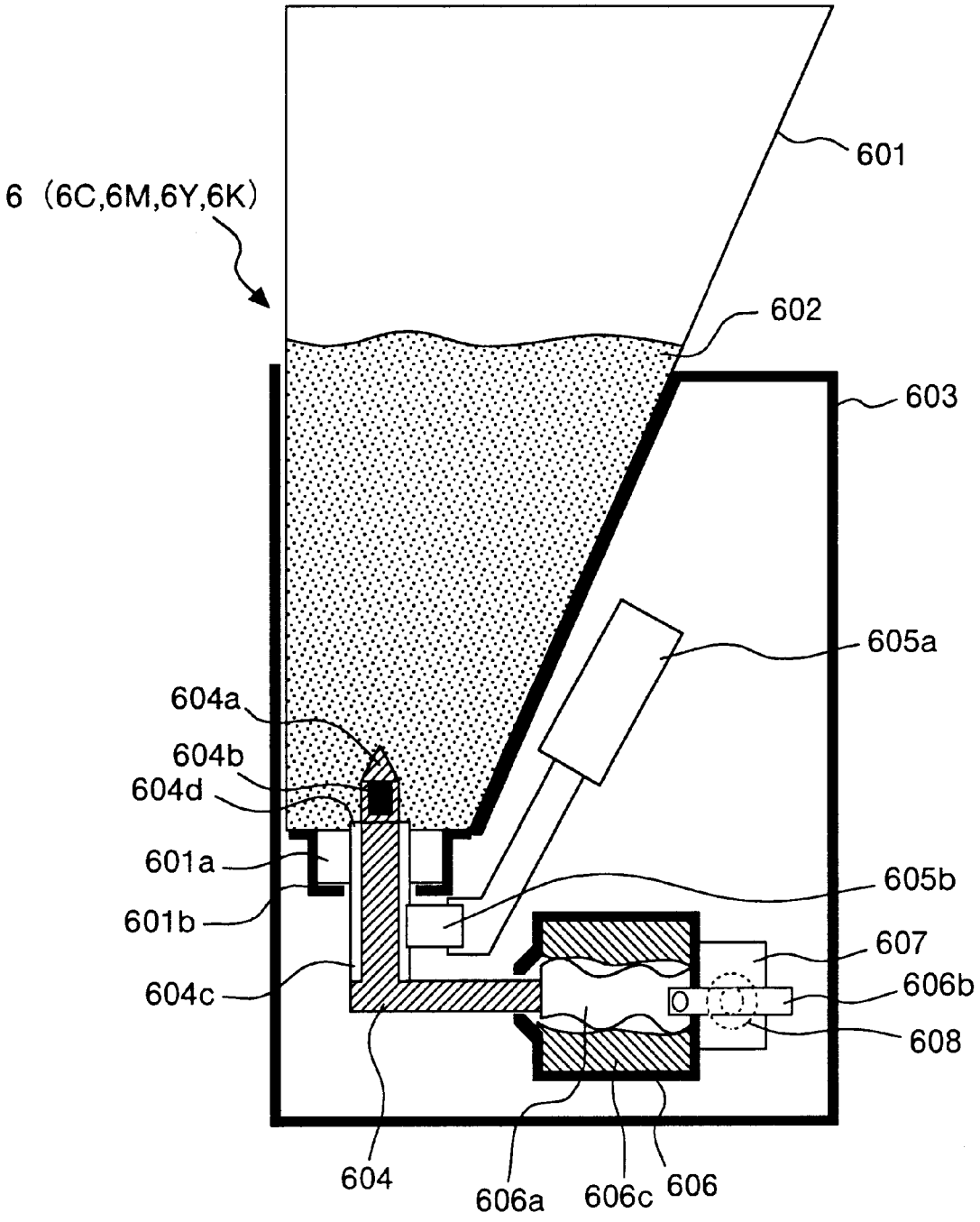
FIG. 14 is a schematic section view snowing a toner feeding unit which is adopted for the image forming apparatus.
Figure 15:
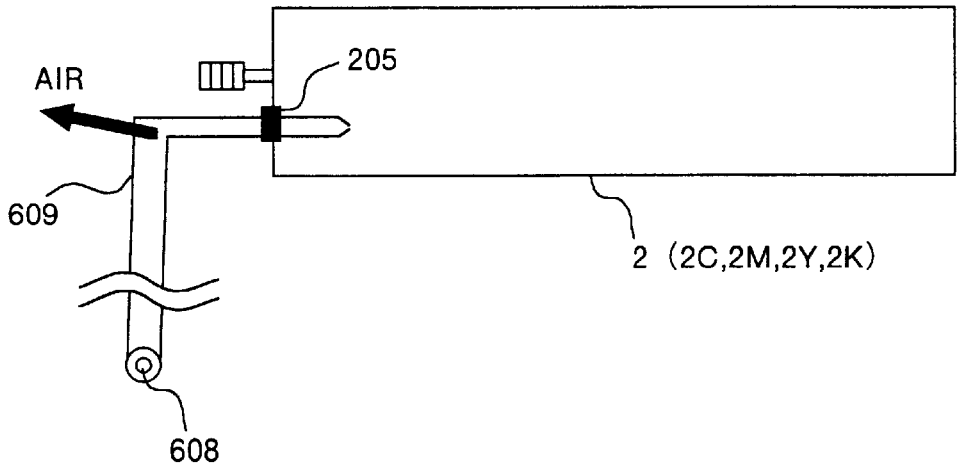
FIG. 15 is a schematic side view showing the positional relation of the toner feeding unit with each engine units.

Then, using FIG. 14 and FIG. 15, the toner feeding units 6C, 6M, 6Y and 6K which are applied to the image forming apparatus of the present preferred embodiment are described. The toner feeding units 6C, 6M, 6Y and 6K have the same structure. Since each toner feeding units 6C, 6M, 6Y and 6K have the same structure, the toner feeding unit is described as Code 6 in FIG. 14. The image forming apparatus of the present preferred embodiment adopts the toner feeding unit which is shown in Japanese Patent Publication (Kokai) No. 2000-227706. The toner feeding units 6C, 6M, 6Y and 6K which are adopted to the image forming apparatus of the present preferred embodiment are units for feeding the toners to the developing unit 203.

The toner feeding units 6C, 6M, 6Y and 6K are constituted by the toner-storing units 601 which is shown in FIG. 14, mechanisms of discharging the toners from the toner-storing units 601, the pipes 609 for feeding the toners to the developing unit 203 which is shown in FIG. 15, the toner tubes not illustrated which connect the toner discharging orifices 608 of the toner-storing units 601 with the pipes 609, etc.

In FIG. 14, the toner-storing unit 601 is a container for storing the toner for supply 602, and is formed in a trapezoid shape in which the horizontal width is narrower as going downward. The toner-storing unit 601 has a closed structure, and a seal valve which comprising the valve body 601*a* made of a foamed sponge or the like and the fixation member 601*b* for fixing the valve body 601*a* is provided at the bottom face.

A crucial penetrated slit is provided at the valve body 601*a*, and the nozzle 604 can be inserted in the inner part of 601. When the toner is exchanged, the valve body 601*a*, and the toner-storing unit 601 including the fixation member 601*b* are attached and detached from the image forming apparatus as a toner cartridge. Further, the part other than the seal valve of the toner-storing unit 601 is made of a paper, it is folded after use, and the reduction of collection and circulation cost can be designed. The toner-storing unit 601 of the present example is constituted to be able to be exchanged from upside by opening a door not illustrated which is provided in the upper part of the image forming apparatus.

The toner-storing unit 601 is set on the supporting frame 603. In a condition in which the toner-storing unit 601 is set, one end of the nozzle 604 is inserted in the toner-storing unit 601, and the edge part 604*a* of the nozzle 604, the air flow-in orifice 604*d*, and the toner-discharging orifice 604*b* are stuck out.

On the other hand, the another end of the nozzle 604 is connected with the suction orifice of the single-screw eccentric screw pump 606. The screw pump 606 has a rigid rotor 606*a* which is made in a eccentric screw shape, and the stator 606*c* which is made in a double-stripe screw shape which is made of an elastic body such as a rubber or the like and fixed to be set. The rotor 606*a* is driven by rotation through the drive shaft 606*b* which rotates receiving driving force from a motor not illustrated. Further, the air pump 605*a* is connected with air passage through the air connection orifice 605*b*.

The toner feeding by the toner feeding unit 6 having such constitution is carried out as follow. Firstly, the variation of the mixing ratio of the toner and the carrier is detected based on a magnetic permeability detector not illustrated which is provided at one part of the developing unit 203. When the requirement of the toner is judged, air in the air pump 605*a* is sent from the air flow-in orifice 604*d* in the inner part of the toner-storing unit 601 through the air connection orifice 605*b* and the passage for air 604*c*. At this time, the rotor 606*a* in the single-screw eccentric screw pump 606 starts also simultaneously rotational drive, and a strong self-absorbing force is generated in the single-screw eccentric screw pump.

Then, the toner in the toner-storing unit 601 which is fluidized by air stream which is sent from the air pump 605*a* is discharged out of the toner-storing unit 601 by air pressure, the suction force of the single-screw eccentric screw pump and the like through the toner-discharging orifice 604*b*. Then, the toner is sucked by the single-screw eccentric screw pump, and sent to the pipes 609 and the developing unit 203 through the toner discharging orifice 608 and the toner carrying tube not illustrated. Then, as shown in FIG. 15, an air filter is provided at one portion of the pipe 609, only air in the mix flow of the toner and air stream is degassed from the pipe 609, the scattering of the toner from the developing unit 203 is prevented. The single-screw eccentric screw pump 606 which is used in the toner feeding units 6C, 6M, 6Y and 6K of the present preferred embodiment can carry out a continuous quantitative deliver at a high solid/air ratio, and an accurate toner transfer amount proportional to the rotational number of the drive shaft 606*b* is obtained. Accordingly, the control of toner transfer amount can be easily and accurately carried out by controlling the drive time of the screw pump.

As described above, since each engine units (imaging units) 2C, 2M, 2Y and 2K of the first preferred embodiment carried out the elongation of life time of the carrier and the photosensitizer 201 whose life time is conventionally short, the engine units (imaging units) 2C, 2M, 2Y and 2K become long life as a whole, therefore running cost can be also reduced. Further, in the first preferred embodiment, a case of two components-development is described, but when a known one component-development is used, the elongation of life time of the imaging units can be attained by only mounting the elongation technology of life time of the photosensitizer on the imaging units.

Further, in the first preferred embodiment, since each engine units (imaging units) 2C, 2M, 2Y and 2K and the supporting member 11 are integrally constituted to be unitized, a plurality of the imaging units which constitute the units can be simultaneously reused. Thus, it is prevented that the imaging units are separately loaded on the reuse process. Further, it is possible to simultaneously reuse the imaging units which have nearly the same residual life time without the management of the residual life time by every imaging unit, and the management at reusing the long life imaging unit can be easily carried out.

Further, in the first preferred embodiment, since it is constituted that the unit which is obtained by integrating each engine units (imaging units) 2C, 2M, 2Y and 2K and the supporting member 11 is attachable to and detachable from a main body of the image forming apparatus, the unit can be detached without decomposing the main body of the image forming apparatus. Thus, the unit can be loaded on the reuse process at a short time, and the operationability can be improved.

Further, in the first preferred embodiment, since it is constituted that the unit is attachable to and detachable from the image forming apparatus and fixed by enhancing the difficulty in fixation and detachment and a user cannot easily detach it, it can be surely collected and the collection rate can be improved, therefore it is suitable for reuse. Since the imaging units of the present preferred embodiment is not frequently required for maintenance, it is unnecessary to expect exchange by user as a process cartridge. It is rather desirable that the imaging units are fixed in the image forming apparatus and the attachment and detachment only by a maker are carried out considering a sure reuse of the long life imaging units. Further, since it is a constitution that the attachment and detachment of the unit can be carried out only by a maker who is a expert group, attachment error is reduced and the point of quality control is superior.

Further, the unit of attachment and detachment in the image forming apparatus the unit which integrated each engine units (imaging units) 2C, 2M, 2Y and 2K and the supporting member 11 is not limited to the screw 11*b* (fixation unit) whose head part is formed in a S-character shape and an S-character shape driver (detachment unit) A unit of fixation and detachment the unit using keys such as a metal piece, a card and the like, a unit of fixing and detaching it using a specific jig, a unit of fixing and detaching it by inputting a fixed number, a unit of confirming personal information such as a finger print, voice or the like, etc. may be used. In this case, from the viewpoint of a sure reuse, it is desirable to be constituted that the unlocking of a unit cannot be detached unless a specific person who is preliminarily determined, Further, in order to attain the first object "Integral reuse of the imaging units which have nearly the same residual life time" of the present invention, a plurality of the imaging units may constitute the unit by being integrated, and it is not always necessary to be attached and detached from the main body of the image forming apparatus. For example, the unit maybe able to be detached after disjointing the image forming apparatus.

Figure 16:
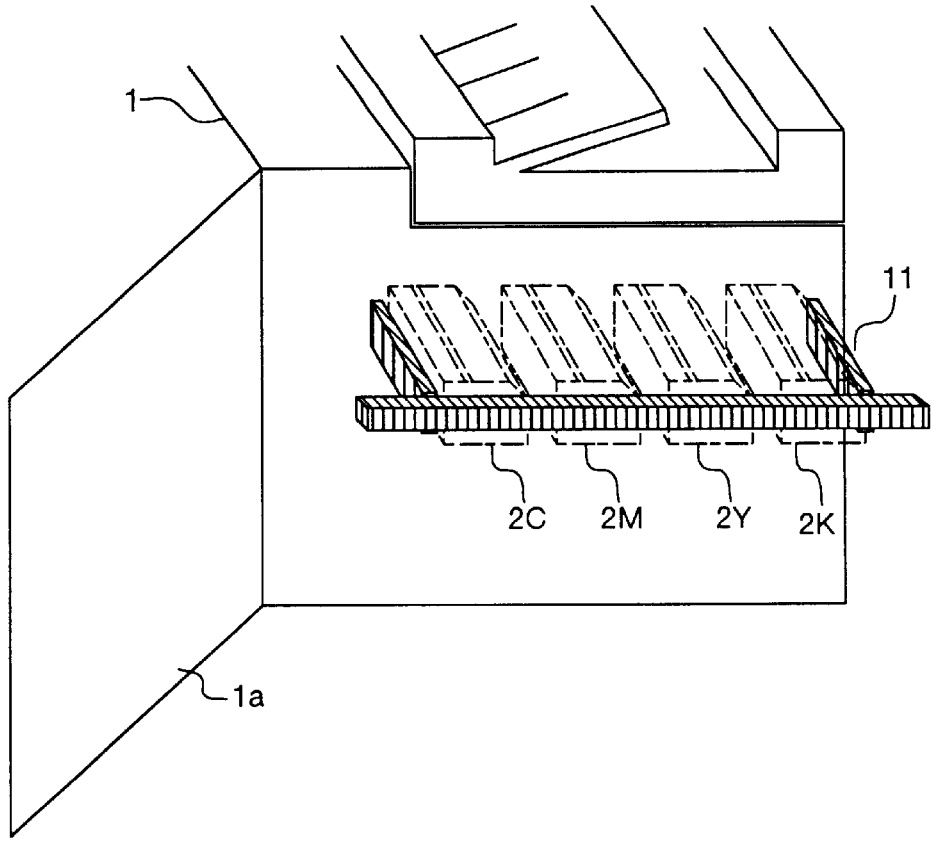
FIG. 16 is a view for illustrating the other attachment structure of each engine units of an image forming apparatus.

Further, even if the unit is constituted to be able to be detached, the fixation unit is not essential, and for example, as shown in FIG. 16, the unit may be constituted. FIG. 16 is a view for illustrating the other attachment structure of each engine units of the image forming apparatus. FIG. 16 has a constitution that there are no screws 11*b* for fixing the supporting member 11, being different from the constitution in the FIG. 5. Thus, in order to attain the first object "Integral reuse of the imaging units which have nearly the same residual life time" of the present invention, the fixation unit is not essential.

Further, since the storing part for the toner for supply and the waste toner-storing part are provided separately to each engine units (imaging units) 2C, 2M, 2Y and 2K, each engine units (imaging units) 2C, 2M, 2Y and 2K can be made in a small size, and a circumstance that each engine units (imaging units) 2C, 2M, 2Y and 2K cannot be used until the termination of life time because of the fill-up of the waste toner and the like can be prevented.

Further, by using the intermediate transfer belt 8, a paper powder from a recording paper or the like as a recording medium is not directly adhered on each engine units (imaging units) 2C, 2M, 2Y and 2K 201, therefore the elongation of the life time of each engine units (imaging units) 2C, 2M, 2Y and 2K can be designed.

Figure 17:
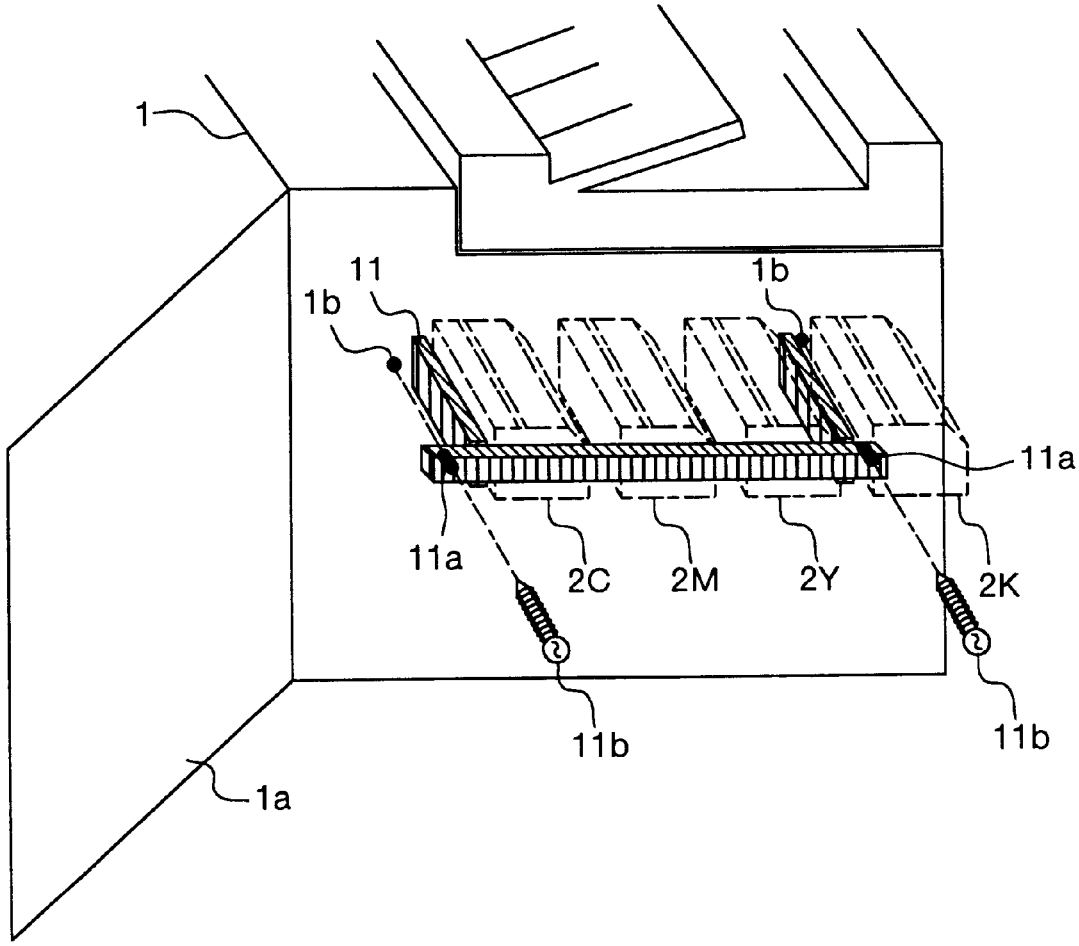
FIG. 17 is a view for illustrating the attachment structure of each engine units of an image forming apparatus related to a second preferred embodiment.

Then, the color image forming apparatus related to the second preferred embodiment is described. The same codes are bestowed to those having the same constitution as in the first preferred embodiment, and their illustration is abbreviated. Further, each imaging units such as the photosensitizer, the developing unit, the developing agent and the like which are used in each engine units of the present preferred embodiment are the same as those in the first preferred embodiment. FIG. 17 is a view for illustrating the attachment structure of each engine units of the color image forming apparatus related to the second preferred embodiment.

In the first preferred embodiment, each engine units (imaging units) 2C, 2M, 2Y and 2K are constituted as an integral unit, but in the second preferred embodiment, as shown in FIG. 17, each engine units (imaging units) 2C, 2M and 2Y are constituted as an integral unit, and the engine unit 2K in which the difference in the residual life time tends to appear is constituted as a separate body.

Thus, the engine units (imaging units) 2C, 2M and 2Y which have the nearer residual life time can be reused together, and the engine unit (imaging unit) 2K can be reused alone. Concerning the engine unit (imaging unit) K (black), the management of the residual life time must be carried out, but the K (black) has a large difference of the residual life time when the output of the K (black) and the like are often carried out, and the K (black) having the same residual life time as the residual life times of other colors is not always required to be put in, therefore it is also rational to separately manage the K (black) from the other colors.

Further, the present invention is not limited to the preferred embodiment, and it can be carried out by appropriately being changed within a range of not changing the purport of the present invention. For example, four full colors are described in the examples above, but a multi-color comprising two colors and the like (for example, a black engine unit and a red engine unit are integrally constituted), or a unit integrating the imaging units comprising the same colors may be constituted.

According to the image forming apparatus of the first aspect, since at least two imaging units are constituted in one integrated unit, a plurality of imaging units which constitute the unit can be simultaneously reused. Thus, the imaging units whose residual life time is near can be simultaneously reused without managing the residual life time, therefore the image forming apparatus in which the management at reusing the imaging units whose life time is elongated can be easily carried out can be provided.

Further, according to the second aspect of the invention, in the image forming apparatus of the first aspect, since it is constituted that the unit is attachable to and detachable from the main body of the image forming apparatus, the unit can be detached without disjointing the main body of the image forming apparatus, it can be loaded on the reuse process in a short time, and operationability can be improved.

Further, according to the third aspect of the invention, in the image forming apparatus of the second aspect, since a fixation unit of fixing the unit detachably and the degree of difficulty of the detachment of fixation is provided against the main body of the image forming apparatus, the detachment of the unit against the main body of the image forming apparatus can be carried out by only the service man of a maker and the like, and it is difficult that a user himself carries out it. Thus, the unit of the image forming apparatus can be surely collected by the maker side, and it is possible to easily load it on the recycle process.

Further, according to the fourth aspect of the invention, in the image forming apparatus of any one of the first to the third aspects, since the unit is constituted by jointing a plurality of imaging units by the supporting member, a plurality of imaging units can be unitized by a simple constitution.

Further, according to the fifth aspect of the invention, in the image forming apparatus of the third aspect, since the fitting groove in which the edge of the driver is fit, of the screw as the fixation unit is formed in a curve form, the attachment and detachment of the screw cannot be carried out unless a screw driver having a specific edge form is used. Thus, each imaging units of the image forming apparatus can be surely collected by the maker side, and it is possible to easily load them on the recycle process.

Further, according to the sixth aspect of the invention, in the image forming apparatus of any one of the first to the fifth aspects, since the four imaging units for respectively forming toner images of a cyan color, a magenta color, a yellow color and a black color are unitized by being arranged in a row, each color imaging units (a cyan color, a magenta color, a yellow color and a black color) can be integrally reused.

Further, according to the seventh aspect of the invention, in the image forming apparatus of any one of the first to the fifth aspects, since the unit is integrally constituted by arranging in a row the three imaging units of the four imaging units for respectively forming toner images of cyan color, magenta color and yellow color, and the imaging unit of preparing a toner image of the black color is made as a separate body, the imaging units of a cyan color, a magenta color and a yellow color whose residual life time is nearer can be integrally reused.

Further, according to the eighth aspect of the invention, in the image forming apparatus of any one of the first to the seventh aspects, since a toner feeding unit for feeding toner to the development unit is provided separately from the unit, toner can be fed to the unit from outside, and it can be prevented that the toner in the unit is exhausted before the unit terminates its life time.

Further, according to the ninth aspect of the invention, in the image forming apparatus of the eighth aspect, since it is constituted that when the unit is fixed to the main body of the image forming apparatus by the fixation unit, the development unit and the toner feeding unit are hooked and linked, there is no requirement other than the detachment of the fixation unit when the unit is detached from the main body of the image forming apparatus, and operationability can be improved.

Further, according to the tenth aspect of the invention, in the image forming apparatus related to the ninth aspect, since the toner storing unit is provided separately from the unit, a waste toner can be discharged to the outside of the unit. Thus, it can be prevented to be unable to use because the waste toner is filled up in the unit before the unit terminates its life time.

Further, according to the eleventh aspect of the invention, in the image forming apparatus of any one of the first to the tenth aspects, since the toner image which is formed on the image carrier is transferred on the recording medium through the intermediate transfer body, for example, as the recording medium, a paper powder such as a recording paper or the like is not directly adhered on the photosensitizer as the image carrier, and the elongation of the life time of the unit can be designed.

Further, according to the twelfth aspect of the invention, in the image forming apparatus of any one of the first to the eleventh aspects, since the image carriers of each imaging units have the particle-like substance, the surface layer of the image carrier is gradually shaved by a cleaning blade, the particle-like substance becomes naked to a certain degree, and the particle-like substance is naturally pealed, a new surface layer is exposed on the surface of the image, and the elongation of the life time of the image carrier and refresh effect can be attained together.

Further, according to the thirteenth aspect of the invention, in the image forming apparatus of the twelfth aspect, since the content of the particle-like substance in the surface layers of the image carriers is 5 to 50% by weight, the wear resistance of the image carriers can be improved without damaging the transparency of the photosensitive layer of the image carriers.

Further, according to the fourteenth aspect of the invention, in the image forming apparatus of the twelfth or thirteenth aspect, since an average particle diameter of the particle-like substance is 0.05 to 1.0 $\mu$m, an adequate wear resistance effect is obtained, and it can be prevented that the portion of the particle-like substance is protruded on the surface of the image carriers, and damages the cleaning blade, therefore it causes the inferiority of cleaning.

Further, according to the fifteenth aspect of the invention, in the image forming apparatus of the twelfth, thirteenth or fourteenth aspect, since the thickness of a case of forming by lamination of the layered particle-like substance layer in which the particle-like substance is added is 0.5 to 10 $\mu$m, an appropriate film thickness can be made.

Further, according to the sixteenth aspect of the invention, in the image forming apparatus of any one of the first to the eleventh aspects, since the coating layer with wear resistance having elasticity which comprises the soft segment and the hard segment is obtained on the surface of a core material which comprises at least a magnetic substance, of the carrier, a contact accompanied with an intensive impact to the coating layer which is caused by the friction with toner or the mutual friction of the carriers is absorbed at stirring for charging the developing agent by friction. Thus, the toner spent to the toner can be suppressed, the shave of the film can be prevented, and the durability can be also improved.

Further, according to the seventeenth aspect of the invention, in the image forming apparatus of the sixteenth aspect, since the carrier contains a larger particle than the thickness of the coating layer, the particle becomes convex as compared with the coating film of the image. Thus, a contact accompanied with an intensive impact to the coating layer which is caused by the friction with toner or the mutual friction of the carriers can be mitigated by stirring for electrifying the developing agent by friction. Further, the toner spent to the carrier can be prevented thereby, and the film shaving of a coating resin which is the spot of electrification occurrence can be prevented.

Further, according to the eighteenth aspect of the invention, in the image forming apparatus of the seventeenth aspect, since the content of the particle is 20 to 80% by weight based on the coating resin of the coating layer, an effect of mitigating a contact accompanied with an intensive impact to the coating resin is obtained adequately, and an adequate electrification ability can be obtained.

The present document incorporates by reference the entire contents of Japanese priority documents, 2000-298697 filed in Japan on Sep. 29, 2000 and 2001-278930 filed in Japan on Sep. 13, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of imaging units each for forming an image on a recording medium, the plurality of imaging units having at least two imaging units integrated into a unit;

a plurality of image carriers provided in the plurality of imaging units, respectively;

a plurality of development units each for visualizing an electrostatic latent image on an image carrier by toner, the plurality of developing units being provided in the plurality of imaging units, respectively; and a toner feeding unit for feeding toner to at least two developing units of the plurality of developing units in the at least two imaging units integrated into the unit, the toner feeding unit being provided separately from the unit, wherein the toner feeding unit and the at least two developing units in the at least two imaging units are configured to engage with each other.

2. An image forming apparatus according to claim 1, wherein the unit is attachable and detachable from a main body of the image forming apparatus.

3. An image forming apparatus according to claim 2, further comprising a fixation unit which fixes the unit detachably from the ma in body of the image forming apparatus such that the degree of difficulty of fixation is changeable.

4. An image forming apparatus according to claim 3, wherein the fixation unit comprises a screw which fixes the unit to the main body of the image forming apparatus using a screw driver, and a fitting groove which is formed on the head part of the screw and in which the edge of the driver is fit is formed in a curve form.

5. An image forming apparatus according to claim 3, further comprising an interlock mechanism configured to interlock the development units and the toner feeding unit when the unit is fixed to the main body of the image forming apparatus by the fixation unit.

6. An image forming apparatus according to claim 5, wherein each imaging unit integrated in the unit includes a cleaning unit for eliminating residual toner on the image carrier, and a toner storing unit for storing waste toner eliminated by the cleaning unit from the image carrier is positioned separately from the unit.

7. An image forming apparatus according to claim 1, wherein the unit is constituted by jointing the at least two imaging units by a supporting member.

8. An image forming apparatus according to claim 1, wherein the plurality of imaging units comprise four imaging units for respectively forming toner images of a cyan color, a magenta color, a yellow color and a black color, and the unit is integrally constituted by arranging the four imaging units in a row.

9. An image forming apparatus according to claim 1, wherein the plurality of imaging units comprises four imaging units for respectively forming toner images of a cyan color, a magenta color, a yellow color and a black color, and the unit is integrally constituted by arranging in a row the three imaging units of the four imaging units for respectively forming toner images of cyan color, magenta color and yellow color.

10. An image forming apparatus according to claim 1, wherein the toner image formed on the image carrier is transferred on the recording medium through an intermediate transfer member.

11. An image forming apparatus according to claim 1, wherein the image carrier of the each imaging unit which constitutes the unit contain a particle-like substance on a surface layer of the image carrier.

12. An image forming apparatus according to claim 11, wherein an average particle diameter of the particle-like substance is 0.05 to 1.0 $\mu$m.

13. An image forming apparatus according to claim 11, wherein a film thickness formed by lamination of layered particle-like substance layers in which the particle-like substance is added is 0.5 to 10 $\mu$m.

14. An image forming apparatus according to claim 11, wherein the content of the particle-like substance in the surface layer of the image carrier is 5 to 50% by weight.

15. An image forming apparatus according to claim 14, wherein an average particle diameter of the particle-like substance is 0.05 to 1.0 $\mu$m.

16. An image forming apparatus according to claim 14, wherein a film thickness formed by lamination of layered particle-like substance layers in which the particle-like substance is added is 0.5 to 10 $\mu$m.

17. An image forming apparatus according to claim 1, wherein the development unit in each imaging unit integrated in the unit develops the latent image on the image carrier by a two components developer which contains toner and carrier, and the carrier provides a coating layer comprising soft segment and hard segment on a surface of a core material comprising at least magnetic substance.

18. An image forming apparatus according to claim 17, wherein the coating layer of the carrier contains a larger particle than the thickness of the coating layer.

19. An image forming apparatus according to claim 18, wherein the content of the particle is 20 to 80% by weight based on coating resin of the coating layer.

* * * * *